US008113851B2

(12) United States Patent
Hamner et al.

(10) Patent No.: US 8,113,851 B2
(45) Date of Patent: Feb. 14, 2012

(54) CONNECTOR ASSEMBLIES AND SYSTEMS INCLUDING FLEXIBLE CIRCUITS

(75) Inventors: Richard Elof Hamner, Hummelstown, PA (US); Robert Neil Mulfinger, York Haven, PA (US); Jason M'Cheyne Reisinger, Carlisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/855,249

(22) Filed: Aug. 12, 2010

(65) Prior Publication Data

US 2010/0303415 A1 Dec. 2, 2010

Related U.S. Application Data

(63) Continuation-in-part of application No. 12/428,851, filed on Apr. 23, 2009, now Pat. No. 7,789,669, and a continuation-in-part of application No. 12/428,806, filed on Apr. 23, 2009, now Pat. No. 7,789,668, and a continuation-in-part of application No. 12/686,484, filed on Jan. 13, 2010, and a continuation-in-part of application No. 12/686,518, filed on Jan. 13, 2010.

(51) Int. Cl.
*H01R 9/09* (2006.01)

(52) U.S. Cl. ..... 439/65; 439/260; 439/67

(58) Field of Classification Search ..... 439/65, 439/260, 67, 62, 77, 493
See application file for complete search history.

(56) References Cited

U.S. PATENT DOCUMENTS

| | | | |
|---|---|---|---|
| 4,012,093 | A | 3/1977 | Crane |
| 4,012,095 | A | 3/1977 | Doucet et al. |
| 4,085,990 | A | 4/1978 | Jayne |
| 4,428,632 | A | 1/1984 | Rich |
| 4,518,210 | A | 5/1985 | Morrison |
| 4,560,221 | A | 12/1985 | Olsson |
| 4,603,928 | A | 8/1986 | Evans |
| 4,626,056 | A | 12/1986 | Andrews, Jr. et al. |
| 4,629,270 | A | 12/1986 | Andrews, Jr. et al. |
| 4,731,698 | A | 3/1988 | Millot et al. |
| 4,840,569 | A | 6/1989 | Cabourne |
| 4,895,521 | A | 1/1990 | Grabbe |
| 4,895,522 | A | 1/1990 | Grabbe et al. |

(Continued)

FOREIGN PATENT DOCUMENTS

EP 0459356 8/1995

OTHER PUBLICATIONS

Neoconix PCBeam™ Interposer Design Guide, Neoconix, Rev. 070925, 4 pgs.

*Primary Examiner* — Gary F. Paumen

(57) ABSTRACT

A connector assembly that includes a base frame extending along a longitudinal axis between a pair of frame ends. The connector assembly also includes a moveable side that is supported by the base frame and extends in a direction along the longitudinal axis. The moveable side includes a mating array of terminals. The connector assembly also includes a flex connection that is communicatively coupled to the mating array. The flex connection and the mating array are configured to transmit data signals. The connector assembly also includes a coupling mechanism that is supported by the base frame and is operatively coupled to the moveable side. The coupling mechanism is configured to be actuated to move the moveable side between retracted and engaged positions along a mating direction.

20 Claims, 15 Drawing Sheets

U.S. PATENT DOCUMENTS 5,092,781 A 3/1992 Casciotti et al.
5,102,342 A 4/1992 Marian
5,171,154 A 12/1992 Casciotti et al.
5,228,863 A 7/1993 Campbell et al.
5,441,424 A 8/1995 Morlion et al.
5,676,559 A 10/1997 Laub et al.
5,772,451 A 6/1998 Dozier, II et al.
RE36,065 E 1/1999 Andrews et al.
5,904,581 A 5/1999 Pope et al.
6,027,345 A 2/2000 McHugh et al.
6,062,872 A 5/2000 Strange et al.
6,077,090 A 6/2000 Campbell et al.
6,083,047 A 7/2000 Paagman
6,116,965 A 9/2000 Arnett et al.
6,135,781 A 10/2000 Pope et al.
6,231,391 B1 5/2001 Ramey
6,310,286 B1 10/2001 Troxel et al.
6,394,822 B1 5/2002 McNamara
6,411,517 B1 6/2002 Babin
6,443,745 B1 9/2002 Ellis et al.
6,461,202 B2 10/2002 Kline
6,537,087 B2 3/2003 McNamara et al.
6,551,140 B2 4/2003 Billman et al.
6,623,280 B2 9/2003 Oldenburg et al.
6,672,878 B2 1/2004 Dean
6,682,368 B2 1/2004 Murr et al.
6,695,646 B1 2/2004 Grabbe
6,699,048 B2 3/2004 Johnson et al.
6,705,895 B2 3/2004 Hasircoglu
6,712,620 B1 3/2004 Li et al.
6,739,910 B1 5/2004 Wu
6,743,049 B2 6/2004 Perugini et al.
6,743,057 B2 6/2004 Davis et al.
7,097,470 B2 8/2006 Harper
7,114,961 B2 10/2006 Williams
7,207,807 B2 4/2007 Fogg
7,244,125 B2 7/2007 Brown et al.
7,262,672 B2 8/2007 Lee et al.
7,297,015 B1 11/2007 Desrosiers et al.
7,309,239 B2 12/2007 Shuey et al.
7,374,441 B2 5/2008 Rubenstein
7,390,194 B1 6/2008 Crippen et al.
7,419,400 B1 9/2008 Taylor et al.
7,425,134 B1 9/2008 Taylor
7,429,176 B2 9/2008 Johnescu et al.
7,438,582 B2 10/2008 Taylor
7,465,195 B1 12/2008 Kerrigan et al.
7,470,149 B2 12/2008 Kazama et al.
7,918,683 B1 * 4/2011 Hamner et al. ..... 439/377
2001/0049207 A1 12/2001 Sakata et al.
2002/0151218 A1 10/2002 Figueroa et al.
2003/0027439 A1 2/2003 Johnescu et al.
2003/0064614 A1 4/2003 Tanaka et al.
2003/0082954 A1 5/2003 Espenshade et al.
2003/0162442 A1 8/2003 Panella
2004/0166704 A1 8/2004 Perugini et al.
2004/0174223 A1 9/2004 Achyut
2006/0019517 A1 1/2006 Raistrick et al.
2007/0097662 A1 5/2007 Dean
2007/0197095 A1 8/2007 Feldman et al.
2008/0032524 A1 2/2008 Lemke et al.
2008/0188098 A1 8/2008 Boesch et al.
2008/0214059 A1 9/2008 Rothermel et al.
2008/0227314 A1 9/2008 Taylor
2008/0233806 A1 9/2008 Rothermel et al.

* cited by examiner

CONNECTOR ASSEMBLIES AND SYSTEMS INCLUDING FLEXIBLE CIRCUITS

CROSS-REFERENCES TO RELATED APPLICATIONS

The present application is a continuation-in-part of U.S. patent application Ser. No. 12/428,851 (filed Apr. 23, 2009) now U.S. Pat. No. 7,789,669; Ser. No. 12/428,806 (filed Apr. 23, 2009), now U.S. Pat. No. 7,789,668; Ser. No. 12/686,484 (filed Jan. 13, 2010); and Ser. No. 12/686,518 (filed Jan. 13, 2010). Each of the above applications is incorporated by reference in its entirety.

BACKGROUND OF THE INVENTION

The subject matter herein relates generally to connector assemblies, and more particularly, to connector assemblies that are configured to communicatively couple different communication components through at least one of electrical and optical connections.

Some communication systems, such as servers, routers, and data storage systems, utilize connector assemblies for transmitting signals and/or power through the system. Such systems typically include a backplane or a midplane circuit board, a motherboard, and a plurality of daughter cards. The connector assemblies include one or more connectors that attach to the circuit boards or motherboard for interconnecting the daughter cards to the circuit boards or motherboard when the daughter card is inserted into the system. Each daughter card includes a header or receptacle assembly having a mating face that is configured to connect to a mating face of the connector. The header/receptacle assembly is typically positioned on or near a leading edge of the daughter card. Prior to being mated, the mating faces of the header/receptacle assembly and the connector are aligned with each other and face each other along a mating axis. The daughter card is then moved in an insertion direction along the mating axis until the mating faces engage and mate with each other.

The conventional backplane and midplane connector assemblies provide for interconnecting the daughter cards to the backplane or midplane circuit board by moving the daughter card in an insertion direction, which is the same as the mating direction. In some cases, it may be desirable to mate the daughter card in a mating direction that is perpendicular to the insertion direction. By way of one specific example, the header/receptacle assembly may be on a surface of the daughter card and face a direction that is perpendicular to the insertion direction (e.g., perpendicular to the surface of the daughter card), and the connector may be on the backplane circuit board and also face a direction perpendicular to the insertion direction. In such a case, it may be difficult to properly align and mate the header/receptacle assembly and the connector. Other examples exist in communication systems where it may be difficult to properly align and mate two communication components that have complementary arrays of terminals.

Accordingly, there is a need for a connector that facilitates interconnection of communication components (e.g., circuit boards, other connectors) when the communication components are oriented in an orthogonal relationship. Furthermore, there is a general need for various connectors capable of establishing an electrical and/or optical connection between different components.

BRIEF DESCRIPTION OF THE INVENTION

In one embodiment, a connector assembly is provided that includes a base frame extending along a longitudinal axis between a pair of frame ends. The connector assembly also includes a moveable side that is supported by the base frame and extends in a direction along the longitudinal axis. The moveable side includes a mating array of terminals. The connector assembly also includes a flex connection that is communicatively coupled to the mating array. The flex connection and the mating array are configured to transmit data signals. The connector assembly also includes a coupling mechanism that is supported by the base frame and is operatively coupled to the moveable side. The coupling mechanism is configured to be actuated to move the moveable side between retracted and engaged positions along a mating direction. The mating array is spaced apart from a complementary array of terminals in the retracted position and communicatively coupled to the complementary array in the engaged position.

At least one of the flex connection and the mating array may be configured to transmit optical signals. The mating array of terminals may include at least one of optical terminals for transmitting optical signals and contact terminals for transmitting electrical current. Optionally, the flex connection may include a plurality of optical fibers for transmitting optical signals. Also optionally, the connector assembly may include a signal converter that is configured to convert electrical signals into or from optical signals.

In another embodiment, a connector assembly is provided that includes a base frame and a moveable side supported by the base frame. The moveable side is moveable relative to the base frame and includes a mating array of terminals. The connector assembly also includes a flex connection that is communicatively coupled to the mating array. The flex connection and the mating array are configured to transmit data signals. The connector assembly also includes a coupling mechanism having an operator-controlled actuator. The actuator is operatively coupled to the moveable side. The actuator is configured to drive the moveable side between retracted and engaged positions along a mating direction. The mating array is spaced apart from a complementary array of terminals in the retracted position and communicatively coupled to the complementary array in the engaged position.

DETAILED DESCRIPTION OF THE INVENTION

Figure 1:
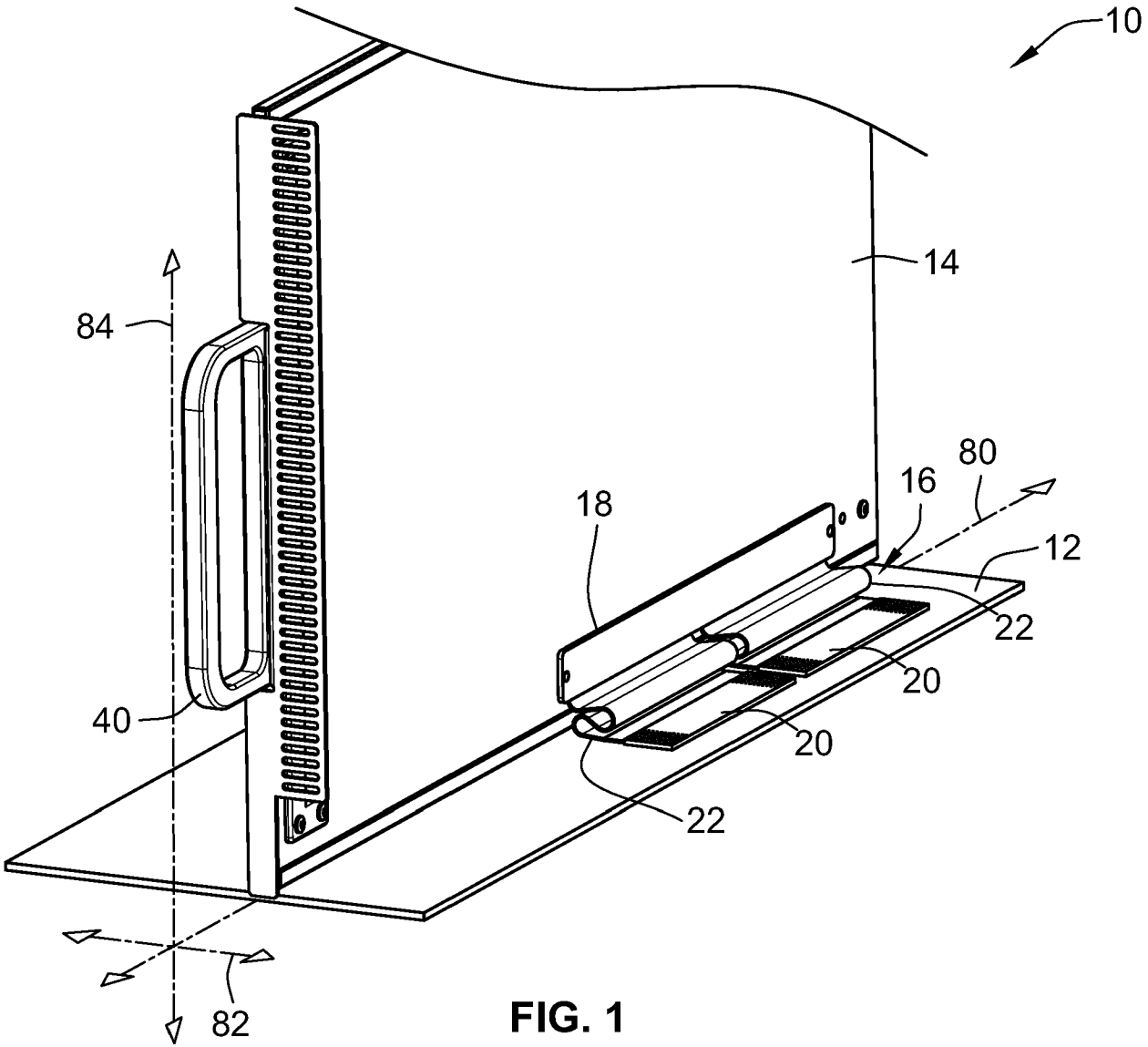
FIG. 1 is a front perspective view of a communication system formed in accordance with one embodiment.

Embodiments described herein include connector assemblies that are configured to establish at least one of an electrical and optical connection to transmit data signals between different communication components. Connector assemblies described herein may also establish an electrical connection to transmit power between the communication components. Communication components that may be interconnected by such connector assemblies include printed circuits (e.g., circuit boards or flex circuits), other connector assemblies (e.g., optical and/or electrical connector assemblies), and any other components that are capable of establishing an electrical or optical connection. The connector assemblies can include one or more moveable sides that include mating arrays of terminals. Each mating array of terminals may be configured to engage a complementary array of terminals of a communication component to establish an electrical and/or optical connection. In some embodiments, the terminals may be contact terminals for establishing an electrical connection or optical terminals for establishing an optical connection.

In some embodiments, the connector assemblies include one or more signal converters that convert data signals in one transmitting form to data signals in another transmitting form. The signal converters may convert electrical signals into or from optical signals. For example, a signal converter may include a modulator that encodes electrical signals and drives a light source (e.g., light-emitting diode) for creating optical signals. A signal converter may also include a detector that detects optical signals and converts the optical signals into electrical signals.

As used herein, the term "mating array" includes a plurality of terminals arranged in a predetermined configuration. The terminals may be held in a fixed relationship with respect to each other. The terminals of a mating array may be held together by a common structure or base material. By way of example, the mating array may be a contact array having a plurality of contact terminals configured to establish an electrical connection. The mating array may also be an optical terminal array having optical terminals configured to establish an optical connection. In some embodiments, the mating array may include both contact terminals and optical terminals.

The contact terminals (or mating contacts) of a contact array may be held together by a common base material or structure, such as a board substrate that includes a dielectric material. For example, a contact array may include or be a component of a printed circuit. A variety of contact terminals may be used in the contact arrays, including contact terminals that are stamped and formed, etched and formed, solder ball contacts, contact pads, and the like. In some embodiments, the contact terminals form a planar array (i.e., the contact terminals are arranged substantially co-planar with respect to each other and face a common direction). In other embodiments, the contact array may have multiple sub-arrays of contact terminals that are not co-planar. Optical terminal arrays may have similar configurations and features as described with respect to the contact arrays.

As used herein, the term "printed circuit," includes any electric circuit in which the conducting connections have been printed or otherwise deposited in predetermined patterns on an insulating base or substrate. For example, a printed circuit may be a circuit board, an interposer made with printed circuit board (PCB) material, a flexible circuit having embedded conductors, a substrate having one or more layers of flexible circuit therealong, and the like. The printed circuit may have contact terminals arranged thereon.

A "flex connection," as used herein, includes flexible pathways that are capable of transmitting electric current and/or optical signals. The flex connection includes a flexible material (e.g., bendable or twistable) and may permit movement of one of the components, such as the mating array. A flex connection may include at least one of an electrical conductor and a fiber optic communication line and may be used to interconnect different mating arrays and/or power contacts. For example, a flex connection may be a flexible circuit configured to convey a current through conductors (e.g., conductive traces) embedded within a flexible substrate. Such a flexible circuit may transmit data and/or power between first and second components, which may include printed circuits and/or mating arrays. Furthermore, a flex connection may include one or more fiber optic communication lines (e.g., fiber optic cables) having optical waveguides that transmit light, for example, by total internal reflection. The optical waveguides may include a flexible cladding. The fiber optic cables may be configured to have a limited bend radius so that optical waveguides may transmit light through total internal reflection. In addition, a flex connection may include electrical conductors (e.g., wires) that are configured to transmit power therethrough. The electrical conductors may have predetermined dimensions (e.g., a predetermined gauge) that are suitable for transmitting a desired amount of electrical power.

A "flexible circuit" (also called flex circuit), as used herein, is a type of flex connection that comprises a printed circuit having an arrangement of conductors embedded within or between flexible insulating material(s). For example, flexible circuit(s) may be configured to convey an electric current between first and second communication components, such as printed circuits. A "fiber optic ribbon" includes a plurality of optical fibers held together by a common layer or ribbon of material. A fiber optic ribbon may include more than one layer or ribbon.

An "interposer," as used herein, includes a planar body having opposite sides with corresponding contact terminals and a plurality of conductive pathways extending therebetween to connect the contact terminals. An interposer may be a circuit board where contact terminals are etched and formed along two opposing sides of the circuit board. The circuit board may have conductive pathways coupling each contact terminal to a corresponding contact terminal on the other side. However, in other embodiments, the interposer might not be a circuit board or another printed circuit. For example, an interposer may include a carrier having a planar body with a plurality of holes extending therethrough. Stamped and formed contact terminals may be arranged by the carrier such that each contact terminal is positioned within a corresponding hole. The contact terminals may interface with one circuit board on one side of the carrier and have ball contacts that are soldered to another circuit board on the other side of the carrier. An interposer may also take other forms.

As used herein, an "alignment feature" includes alignment projections, apertures, and edges, or frames that may cooperate with each other in aligning the terminals. When a mating array is moved toward a communication component and approach the communication component in a misaligned manner, alignment features of the communication component and the connector assembly may cooperate with each other to redirect and align the mating array.

As used herein, a "coupling mechanism" generally includes an operator-controlled actuator and one or more intermediate components that facilitate holding and selectively moving a mating array. For example, the actuator may include an axle that rotates about an axis or a sliding member that slides in an axial direction. The intermediate components include mechanical parts that facilitate operatively coupling the actuator to the moveable side and/or the mating array. For example, the intermediate components may include cams, cam fingers, roll bars, panels, springs, and the like. The intermediate components may facilitate converting a force provided by the actuator into a force that drives the moveable side and/or the mating array between different positions (e.g., retracted and engaged positions).

As used herein, "removably coupled" means that two coupled parts or components may be readily separated from and coupled (electrically, optically, or mechanically) to each other without destroying or damaging either of the two. By way of example, a removable card assembly may be removably coupled to a communication system such that the removable card assembly may be repeatedly inserted and removed from the communication system. The two coupled parts or components may be communicatively coupled. Furthermore, the mating arrays and complementary arrays described herein may be removably coupled such that the mating and complementary arrays are readily separated from and coupled to each other.

As used herein, when two components are "communicatively coupled" or "communicatively connected," the two components can transmit electric current (e.g., for data signals or power) and/or light (e.g., optical data signals) therebetween.

FIG. 1 is a front perspective view of a communication system 10 formed in accordance with one embodiment that includes a first communication component 12 and a second communication component 14 that are communicatively coupled to one another through an interconnect assembly 16. The system 10 may be a variety of communication systems, such as a server system, router system, or data storage system. The first and second communication components 12 and 14 are illustrated as printed circuits and, more specifically, circuit boards. However, the first and second communication components 12 and 14 may be other connectors or other components that are capable of communicating electrical and/or optical signals.

The interconnect assembly 16 may form a transmission pathway between the first and second communication components 12 and 14. As shown, the interconnect assembly 16 includes one or more mating arrays 18 that are configured to engage the second communication component 14, one or more mating arrays 20 that are configured to engage the first communication component 12, and one or more flex connections 22 that interconnect the mating arrays 18 and 20. The mating arrays 18 and 20 may include optical terminals and/or contact terminals. The mating arrays 18 and 20 may be configured to engage complementary arrays of terminals (not shown) along the first and second communication components 12 and 14, respectively. In some embodiments, at least one of the mating arrays 18 and 20 may be moved to and from the first and second communication components 12 and 14, respectively, as described in greater detail below. The flex connections 22 may be configured to transmit data signals. For example, the flex connections 22 may be flexible circuits for transmitting electrical current and/or fiber optic cables for transmitting optical signals. A single flex connection 22 may include one or more optical fibers and one or more conductive pathways.

In some embodiments, the first communication component 12 may be a motherboard and the second communication component 14 may be a removable daughter card, e.g., a line or switch card, that may be removably coupled to or engaged with the interconnect assembly 16. The interconnect assembly 16 is configured to allow the mating array 18 to be moved from a retracted position to an engaged position where the first and second communication components 12 and 14 are communicatively coupled through the interconnect assembly 16. The mating array 18 may be selectively held and moved by, for example, coupling mechanisms 204 (shown in FIG. 4), 304 (FIG. 8), and 404 (FIG. 10), which will be described in further detail below. When the mating array 18 is in the retracted position, the second communication component 14 may be inserted into or removed from the system 10. In some embodiments, the mating array(s) 20 are also selectively held and moved between retracted and engaged positions.

The mating arrays 20 may be mounted to the first communication component 12 by, for example, using press-fit contacts. Alternatively, the mating arrays 20 may be soldered or attached to the first communication component 12 using a fastener and a compressible interface. Also, in other embodiments, the mating array 20 may be part of a removable card assembly and may be moved from a retracted position to an engaged position along the first communication component 12. Such embodiments are described in greater detail in U.S. patent application Ser. No. 12/428,851, which is incorporated by reference in the entirety.

The first and second communication components 12 and 14 may be in fixed or locked positions and substantially orthogonal to one another before the mating array 18 is moved toward and engages the second communication component 14. More specifically, the first communication component 12 extends along a horizontal plane defined by a longitudinal axis 80 and a horizontal axis 82, and the second communication component 14 extends along a vertical or longitudinal plane defined by the longitudinal axis 80 and a vertical axis 84. However, in other embodiments, the first and second communication components 12 and 14 may be substantially orthogonal (or perpendicular) to one another (e.g., 90°+/−20°), parallel to one another, or may form some other angle or some other positional relationship with respect to each other. For example, the first and second communication components 12 and 14 may be oblique to one another.

Also, in some embodiments, the second communication component 14 may include a handle 40 affixed to an edge of the second communication component 14. The handle 40 may facilitate a technician or machine in removing the second communication component 14 from the system 10.

Figure 2:
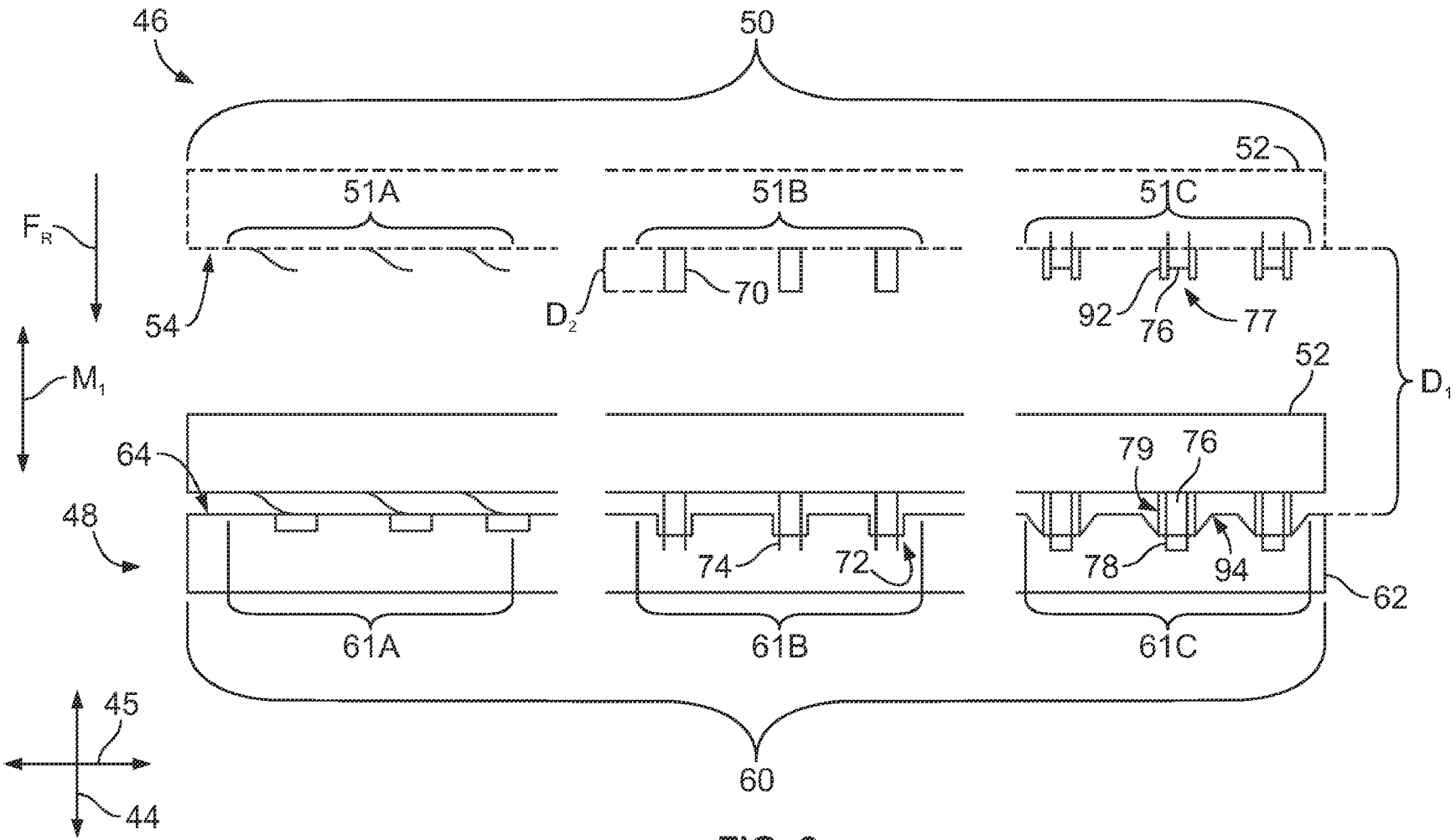
FIG. 2 is a top cross-sectional view of a mating array and a complementary array in retracted and engaged positions with respect to each other.

FIG. 2 is a top cross-sectional view illustrating exemplary mating and complementary arrays 50 and 60, respectively, that may be used in accordance with various embodiments. A communication component 52 may include the mating array 50 and a communication component 62 may include the complementary array 60. FIG. 2 illustrates the mating array 50 in a retracted position 46 (shown in dashed lines) and in an engaged position 48 (solid lines) with respect to the complementary array 60. Although not shown, the mating array 50 may be communicatively coupled to flex connections that permit the mating array 50 to be moved bi-directionally along a mating axis 44 between the retracted and engaged positions 46 and 48. In particular embodiments, the mating array 50 may be moved along the mating axis 44 in a linear manner between the retracted position 46 and the engaged position 48. When the mating array 50 moves in a direction along the mating axis 44, the mating array 50 moves along a mating direction $M_1$. The mating direction $M_1$ may be substantially orthogonal to the longitudinal axis 45.

By way of example, the mating array 50 of terminals may include contact terminals 51A, optical terminals (or fiber terminals) 51B, and optical terminals (or fiber terminals) 51C. The complementary array 60 of terminals may include contact terminals 61A, optical terminals (or fiber terminals) 61B, and optical terminals (or fiber terminals) 61C. Each terminal of the mating array 50 is configured to engage an associated terminal of the complementary array 60. Associated terminals are a pair of terminals that are configured to communicatively couple to each other when the mating and complementary arrays 50 and 60 are engaged.

As shown, the communication component 52 may have a mating or array surface 54 having the mating array 50 thereon, and the communication component 62 has a mating or array surface 64 having the complementary array 60 of terminals thereon. In particular embodiments, the mating surfaces 54 and 64 may extend adjacent to and substantially parallel to each other in the retracted and engaged positions 46 and 48. For example, the mating surfaces 54 and 64 may extend in a direction along a longitudinal axis 45. The longitudinal axis 45 may be substantially orthogonal to the mating axis 44. The mating surfaces 54 and 64 may face each other in the retracted and engaged positions 46 and 48. As will be discussed further below, the mating array 50 may be selectively held and moved by a coupling mechanism (e.g., by coupling mechanisms 204, 304, and 404 shown in FIGS. 4, 8, and 10, respectively) until the associated terminals are engaged. As such, the mating array 50 may be removably coupled to or engaged with the complementary array 60.

In the illustrated embodiment, the mating surface 54 and the mating surface 64 extend substantially parallel to one other while in the engaged and retracted positions 48 and 46, respectively, and in any position therebetween. The associated terminals are spaced apart from each other by substantially the same distance $D_1$ in the retracted position. When the mating array 50 is moved toward the second communication component 62 in a linear manner along the mating axis 44, the distance $D_1$ that separates the associated terminals decreases until the associated terminals are engaged.

The contact terminals 51A may include resilient beams that flex to and from the mating surface 54. The resilient beams resist deflection and exert a resistance force $F_R$ in a direction away from the mating surface 54. The contact terminals 61A are configured to engage the contact terminals 51A. In the illustrated embodiment, the contact terminals 61A are contact pads that are substantially flush with the mating surface 64. However, the contact pads are not required to be substantially flush with the mating surface 64. Furthermore, in alternative embodiments, the contact terminals 51A and 61A may take on other forms including other stamped and formed contacts, etched and formed contacts, solder ball contacts, contact pads, and the like.

The optical terminals 51B include fiber ends 70 that project a distance $D_2$ beyond the mating surface 54. The fiber ends 70 may be sized and shaped relative to fiber cavities 72 of the optical terminals 61B so that the fiber ends 70 are received by the fiber cavities 72 when the mating array 50 is moved into the engaged position 48. In the engaged position 48, the fiber ends 70 are aligned with fiber ends 74 of the optical terminals 61B within the fiber cavities 72. Associated fiber ends 70 and 74 may abut each other to transfer a sufficient amount of light for transmitting optical signals. For example, associated fiber ends 70 and 74 may be configured to minimize any gaps between each other.

Also shown in FIG. 2, the optical terminals 51C include fiber ends 76 located within corresponding fiber channels 77 and alignment features 92 that surround the fiber ends 76 and define the fiber channels 77. The optical terminals 61C include fiber ends 78 and edge surfaces 94 that surround the fiber ends 78. The edge surfaces 94 define fiber cavities 79. The alignment features 92 are projections or caps that are configured to engage the edge surfaces 94. The edge surfaces 94 are shaped to engage the alignment features 92 to align the fiber ends 76 and 78. As shown in FIG. 2, the fiber ends 76 are withdrawn and held within the fiber channels 77 when the mating array 50 is in the retracted position 46. When the mating surfaces 54 and 64 are interfaced with each other in the engaged position 48, the alignment features 92 are received within associated fiber cavities 79. The fiber ends 76 may then advance through the corresponding fiber channels 77 to abut the fiber ends 78 within the fiber cavities 79.

In alternative embodiments, the mating array 50 may be moved toward and engage the complementary array 60 in other manners. In some embodiments, the mating surface 64 and the mating surface 54 may be parallel in the retracted position 46, but the mating and complementary arrays 50 and 60 may be misaligned. In such embodiments, as the mating array 50 approaches the complementary array 60, the mating array 50 may shift or move so that the associated terminals become aligned when the mating array 50 reaches the engaged position 48. In another alternative embodiment, the mating surface 54 and the mating surface 64 may not be parallel when in the retracted position. For example, the mating array 50 may rotate about an axis that extends parallel to the longitudinal axis 45 when the mating array 50 is moved to the engaged position 48.

Figure 3:
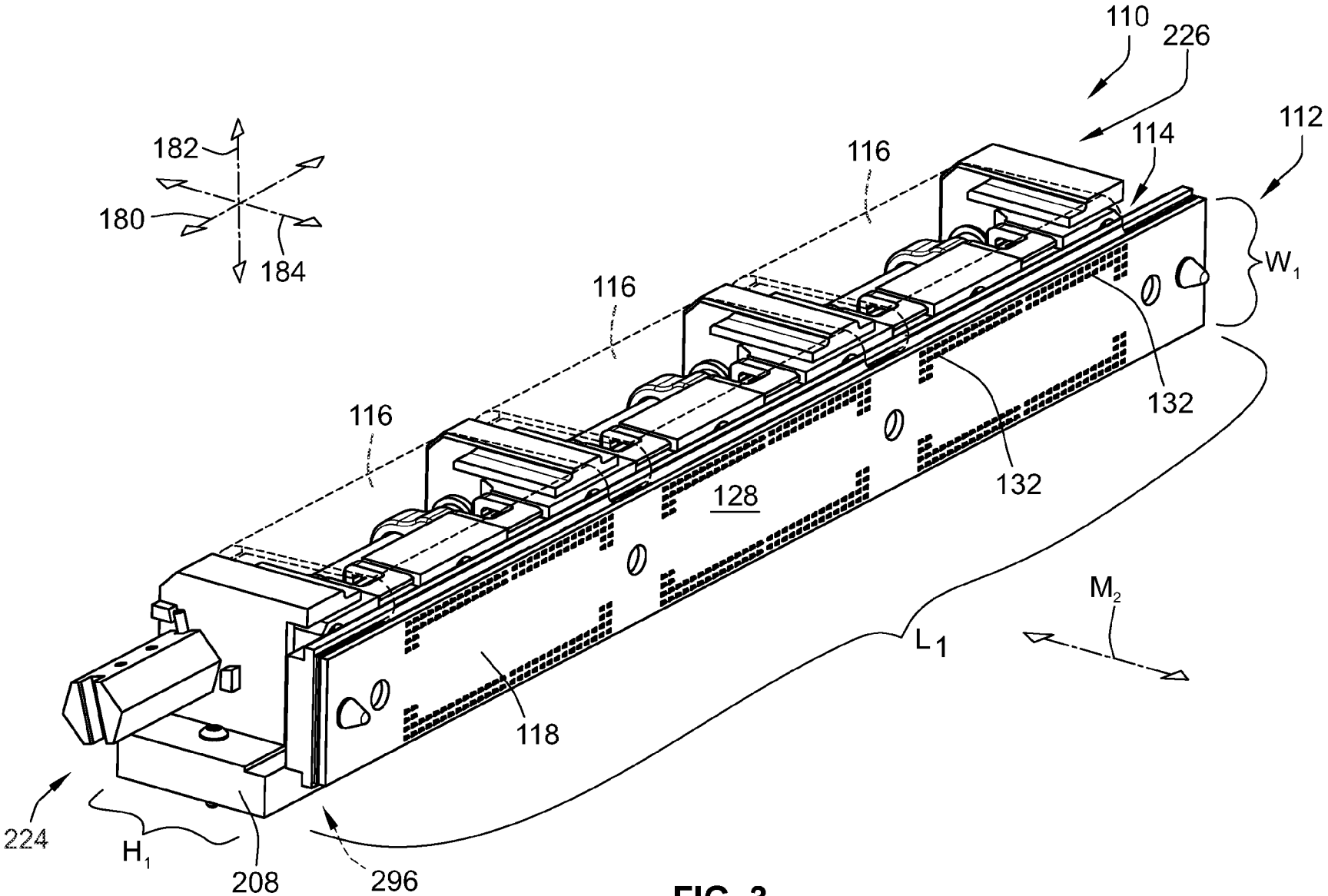
FIG. 3 is a perspective view of a connector assembly formed in accordance with one embodiment.
Figure 4:
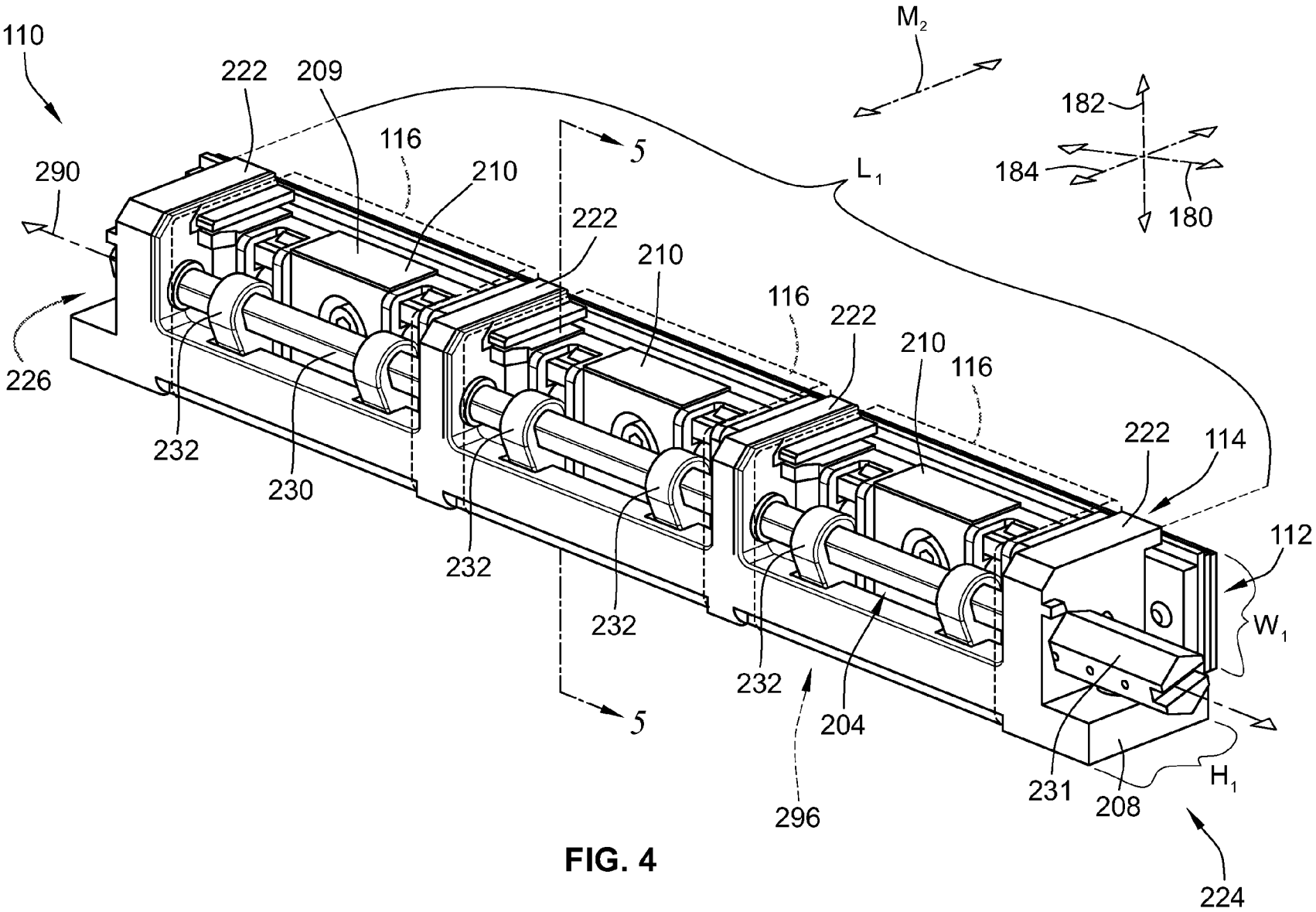
FIG. 4 is another perspective view of the connector assembly shown in FIG. 3.

FIGS. 3 and 4 are isolated perspective views of a connector assembly 110 formed in accordance with one embodiment. The connector assembly 110 includes a moveable side 112 having a mating array 118 (FIG. 3) of terminals 132 (FIG. 3) thereon. The terminals 132 of the mating array 118 may be, for example, the contact terminals and optical terminals described above with respect to FIG. 2. As shown in FIGS. 3 and 4, the connector assembly 110 is oriented with respect to mutually perpendicular axes 180, 182, and 184 that include a longitudinal axis 180, a mating axis 184, and an orientation axis 182.

In the illustrated embodiment, the connector assembly 110 has a substantially rectangular shape that includes a width $W_1$ that extends along the orientation axis 182, a length $L_1$ that extends along the longitudinal axis 180, and a height $H_1$ that extends along the mating axis 184. The connector assembly 110 may include a base frame 208 and a coupling mechanism 204 (FIG. 4) that is supported by the base frame 208. The base frame 208 is configured to be mounted to a communication component or other structure and, as such, may have various shapes and sizes. In the illustrated embodiment, the base frame 208 extends along the longitudinal axis 180 between opposite frame ends 224 and 226. The coupling mechanism 204 is operatively coupled to the moveable side 112 and is configured to be actuated by an operator to move the moveable side 112 in a mating direction $M_2$ along the mating axis 184. The operator that actuates the coupling mechanism 204 may be an individual or a machine.

Figure 5:
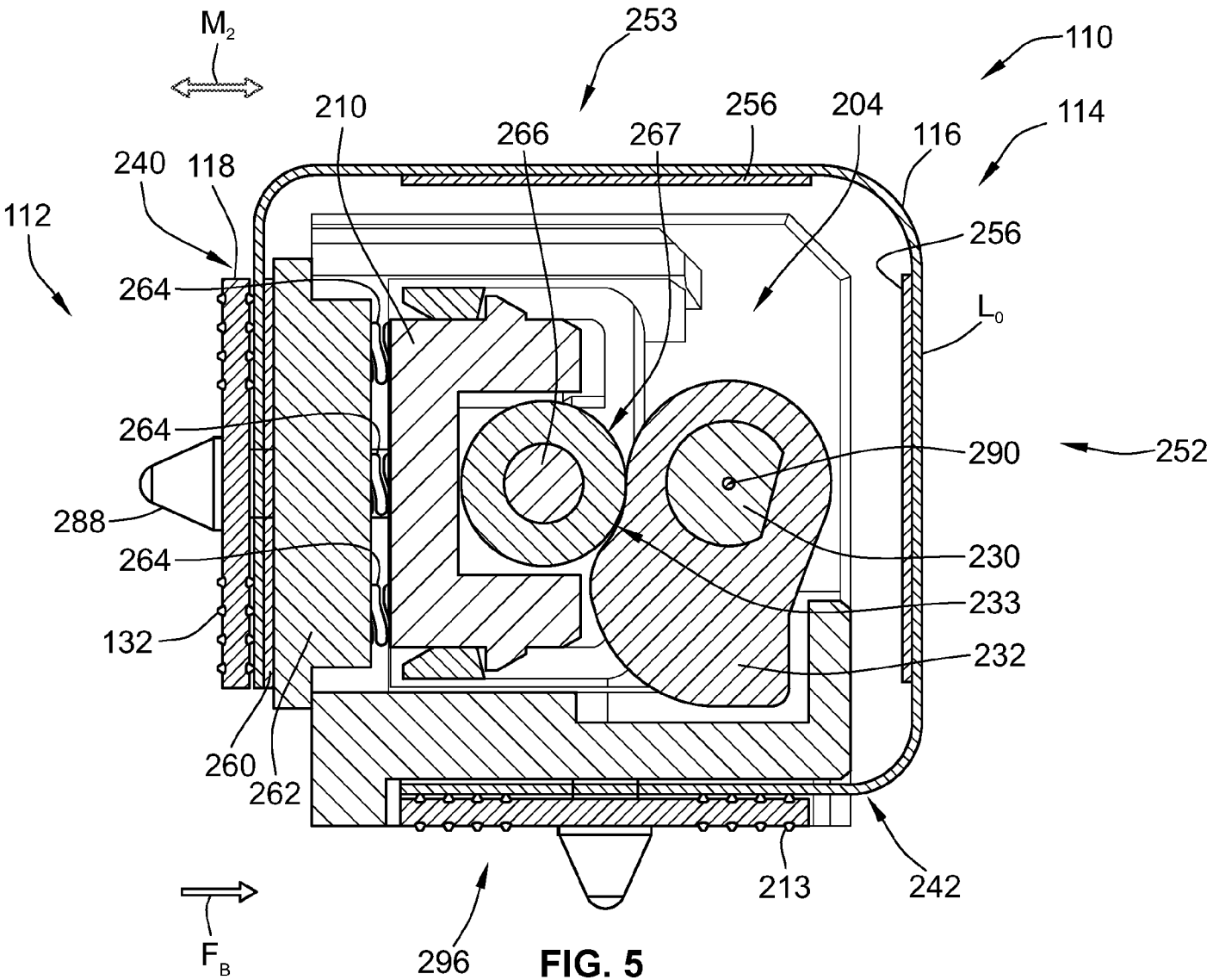
FIG. 5 is a cross-sectional view of the connector assembly taken along the line 5-5 shown in FIG. 4.

Also, the connector assembly 110 includes an interconnect assembly 114 that includes flex connections 116 (indicated by phantom lines in FIG. 4), the mating arrays 118, and a mating array 213 (FIG. 5). The flex connections 116 are communicatively coupled to the mating arrays 118 and 213 and are configured to transmit data signals therebetween. The flex connections 116 may include at least one of optical fibers and conductive pathways for transmitting the data signals between the mating arrays 118 and 213. The flex connections 116 are coupled to the mating array 213 at a mounting side 296 of the connector assembly 110 and extend around the connector assembly 110 to the moveable side 112. As shown in FIG. 3, the moveable side 112 includes the mating array 118 having a mating surface 128 thereon.

With reference to FIG. 4, the coupling mechanism 204 is configured to move the moveable side 112 between the retracted and engaged positions. The coupling mechanism 204 includes an operator-controlled actuator 230. In the illustrated embodiment, the actuator 230 includes an axle. However, the actuator 230 may comprise other mechanical elements in alternative embodiments, such as a sliding member. As shown, the actuator 230 extends along a central axis 290 that, in the illustrated embodiment, extends parallel to the longitudinal axis 180. The coupling mechanism 204 also includes a plurality of cam fingers 232 that are coupled to the actuator 230 and a header 209 having multiple header sections 210 that are coupled to the moveable side 112. The actuator 230 has an engagement end 231 that is configured to be engaged by an operator for rotating the actuator 230 about the central axis 290. Furthermore, the base frame 208 includes a plurality of axle supports 222 that support the actuator 230. More specifically, the base frame 208 supports the actuator 230 and permits the actuator 230 to be moved (e.g., rotated) with respect to the base frame 208 for driving the moveable side 112.

FIG. 5 is cross-sectional view of the connector assembly 110 taken along the line 5-5 shown in FIG. 4. As shown, the flex connection 116 extends around the coupling mechanism 204 to communicatively couple the mating array 213 on the mounting side 296 to the mating array 118 of the moveable side 112. More specifically, the flex connection 116 extends around a perimeter of the cross-section of the connector assembly 110 from the mating array 213 along connector sides 252 and 253. The flex connection 116 of the interconnect assembly 114 may also include rigid substrates or board stiffeners 256 for supporting and providing a shape to the flex connection 116. More specifically, the board stiffeners 256 may extend along portions of the flex connection 116 that extend along connector sides 252 and 253. Furthermore, the flex connection 116 may have a longer length than the perimeter of the connector sides 252 and 253 to allow the moveable side 112 to be moved between retracted and engaged positions 190 and 192 (shown in FIG. 6).

The mounting side 296 may be configured to be mounted to a communication component, such as a circuit board or another connector assembly. The mating arrays 118 and 213 and the flex connection 116 of the interconnect assembly 114 may be molded together into one unit. The mating array 213 may be an interposer that engages the flex connection 116 on one side of the interposer and engages the communication component on the other side of the interposer. The terminals of the mating array 213 may include compressive contacts (e.g., resilient beams), press-fit contacts, or solder-ball contacts that are affixed to a communication component 102 (shown in FIG. 6) to facilitate holding the connector assembly 110 thereto. Alternatively, other terminals, such as optical terminals, may be used.

The moveable side 112 includes the mating array 118, a substrate 260, and a panel 262 that are all fastened together (e.g., with screws or adhesives) and extend substantially parallel to the central axis 290 of the actuator 230. The mating array 118 in FIG. 5 is an interposer, but the mating array 118 may take other forms in alternative embodiments. As shown, the substrate 260 is sandwiched between the panel 262 and the flex connection 116. The substrate 260 may be configured to prevent friction and damage to the flex connection 116. The panel 262 supports the substrate 260 and the mating array 118 and is floatably attached to the header sections 210 (only one header section 210 is shown in FIG. 5). For example, a plurality of springs 264 may be attached at one end to the panel 262 (e.g., through screw or pin shaft) and attached at an opposite end to a corresponding header section 210. The moveable side 112 also includes an alignment feature 288 that projects away from the mating array 118.

Also shown in FIG. 5, the coupling mechanism 204 includes a roll bar 266 that is coupled to and extends through the header sections 210 parallel to the central axis 290. The roll bar 266 has a roll surface 267 that contacts a finger surface 233 of the cam finger 232. In FIG. 5, the coupling mechanism 204 and the moveable side 112 are in the retracted position 190. In the retracted position 190, the cam finger 232 extends longitudinally toward the mounting side 296 and the finger surface 233 is shaped to provide a mechanical advantage when the cam finger 232 is rotated about the central axis 290. The cam finger 232 may be shaped to initially accelerate movement of the moveable side 112 before the alignment feature 288 and terminals 132 engage the communication component 102 and then reduce movement as the alignment feature 288 and terminals 132 engage the communication component 102.

Figure 6:
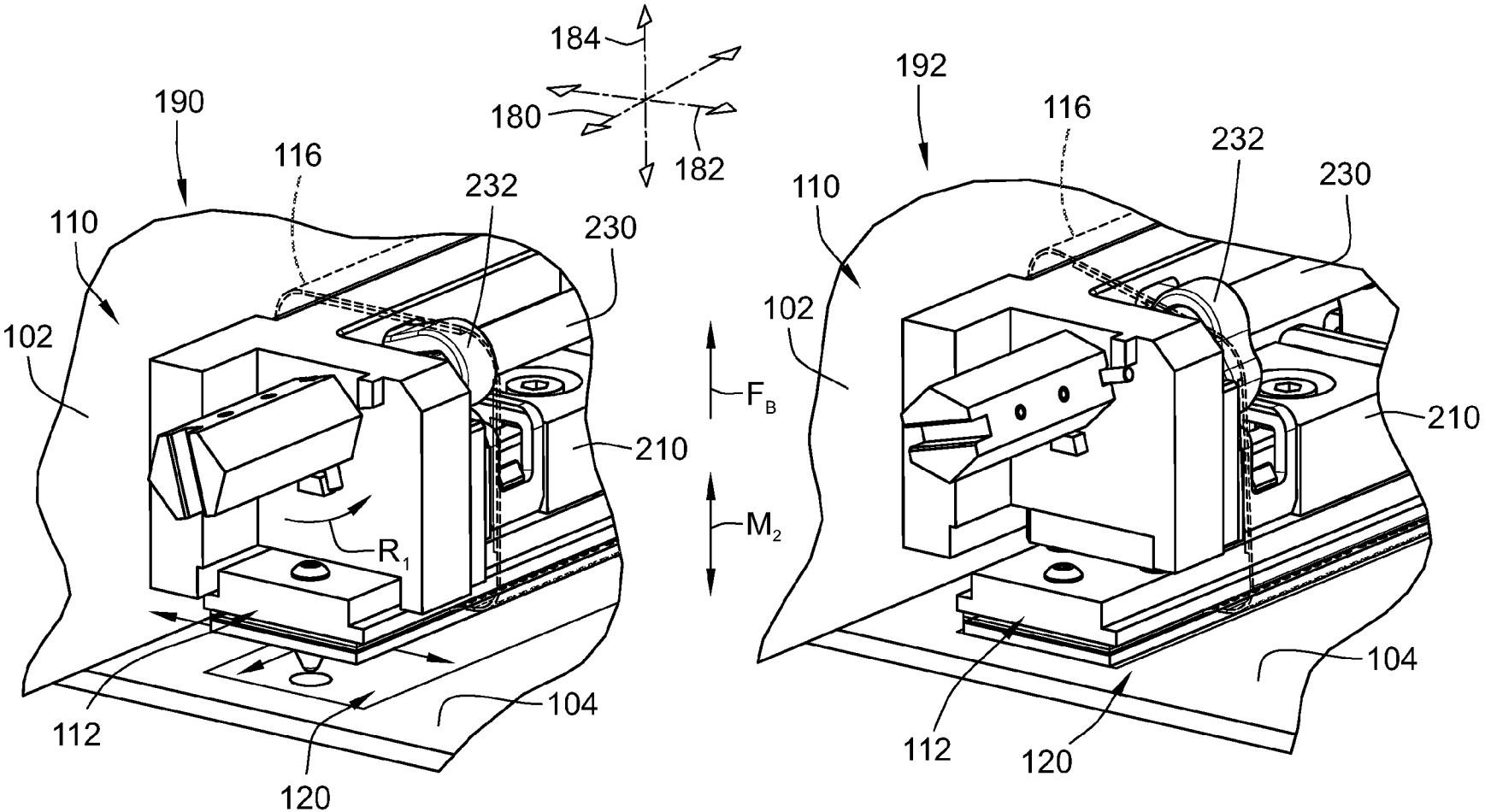
FIG. 6 is a perspective view of an end of the connector assembly shown in FIG. 3 while in retracted and engaged positions.

FIG. 6 illustrates a portion of the connector assembly 110 in the retracted position 190 and in the engaged position 192. In FIG. 6, the connector assembly 110 has been rotated about 90° in a clockwise direction about the central axis 290 (FIG. 4) with respect to FIG. 3. When the actuator 230 is rotated in a direction as indicated by the arrow $R_1$, the cam fingers 232 push the roll bar 266 (FIG. 5) away from the actuator 230 in the mating direction $M_2$. The header section 210, likewise, moves in the mating direction $M_2$ thereby moving the moveable side 112 away from the actuator 230 and toward a complementary array 120 of a communication component 104. Although not shown, the coupling mechanism 204 may be biased (e.g., by a spring force) such that a force $F_B$ biases the header section 210 and the roll bar 266 in a direction toward the actuator 230. (The mating direction $M_2$ and the biasing force $F_B$ are also shown in FIG. 5.) When the actuator 230 is rotated in a direction opposite $R_1$, the biasing force $F_B$ moves the header section 210 and the roll bar 266 toward the actuator 230 and away from the communication component 104. Accordingly, the moveable side 112 may be moved between the engaged and retracted positions 192 and 190.

Also shown in FIG. 6, when the moveable side 112 moves from the retracted position 190 to the engaged position 192, the moveable side 112 pulls the flex connection 116 therealong. Due to the board stiffeners 256 (FIG. 5) that extend along the connector sides 252 and 253 (FIG. 5) the shape of the flex connection 116 changes in a predetermined manner.

Returning to FIG. 5, in particular embodiments in which the flex connections 116 include optical fibers, the board stiffeners 256 and an operative length $L_o$ of the flex connections 116 may be configured to maintain a minimum bend radius of the optical fibers. For example, the operative length $L_o$ of the flex connection 116 may extend between distal and base ends 240 and 242 of the flex connection 116. The distal end 240 is attached to the moveable side 112, and the base end 242 is attached to the mounting side 296. The distal and base ends 240 and 242 have fixed positions. The operative length $L_o$ of the flex connection 116 represents a portion of the flex connection 116 that may be moved when the moveable side 112 is moved between the retracted and engaged positions 190 and 192. The operative length $L_o$ of the flex connection 116 may be configured to limit a bend radius of the optical fibers in the flex connection 116. In alternative embodiments, the base end 242 is attached to another structure. For example, the base end 242 may be attached to the communication component 102.

Figure 7:
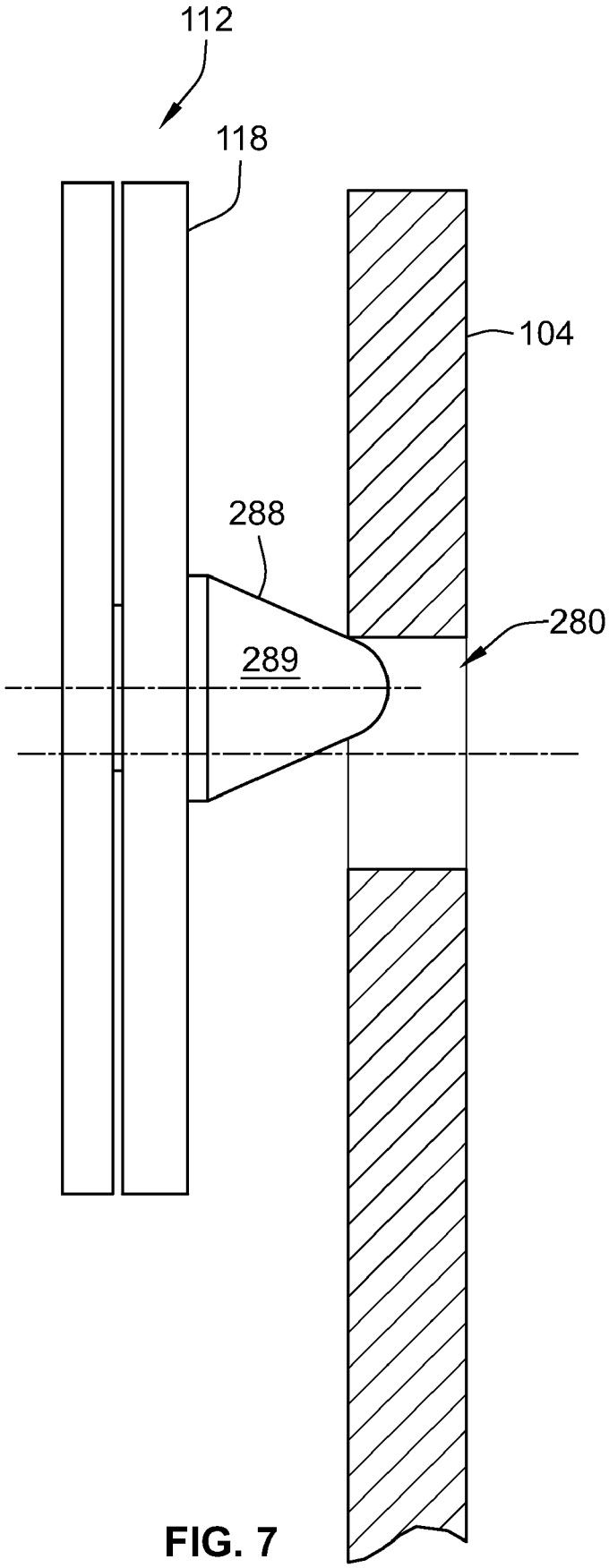
FIG. 7 is a cross-section of a portion of the connector assembly shown in FIG. 6 as the connector assembly is moved between the retracted and engaged positions.

FIG. 7 illustrates an interaction between the alignment feature 288 of the mating array 118 and an aperture 280 of the communication component 104 as the moveable side 112 is moved between retracted and engaged positions 190 and 192 (FIG. 6). Embodiments described herein may utilize one or more alignment mechanisms to facilitate aligning the terminals 132 (FIG. 3) of the mating array 118 and the terminals (not shown) of the communication component 104. As used herein, an "alignment feature" includes a physical structure, such as an alignment projection, an aperture, an edge, or a frame, that may engage another alignment feature to redirect a mating array. The alignment feature may have a fixed relationship with respect to the terminals 132 of the mating array 118. By way of example, the alignment feature 288 may be a conical projection coupled to and extending from the mating array 118. The aperture 280 may be a cavity or passage that is sized and shaped to receive the alignment feature 288 when the mating array 118 is moved from the retracted position 190 to the engaged position 192.

In some embodiments, the mating array 118 may float with respect to the base frame 208 (FIG. 3). For example, the springs 264 (FIG. 5) may allow movement in various directions when a force redirects the mating array 118. More specifically, when the mating array 118 is moved toward the communication component 104, a surface 289 of the alignment feature 288 may engage a wall of the corresponding aperture 280. Due to the shape of the surface 289, the alignment feature 288 and corresponding aperture 280 cooperate with each other to align and communicatively couple the terminals 132 of the mating array 118 and the terminals of the complementary array (not shown).

Returning to FIG. 6, because the communication component 104 is stationary and the mating array 118 is floatable, the mating array 118 may be moved along at least one of the orientation axis 182 and the longitudinal axis 180 (FIG. 3). In other words, the mating array 118 may be floatable in at least one direction that is perpendicular to the mating direction $M_2$ as indicated by the arrows projecting from the moveable side 112. (Although movement of the moveable side 112 along the longitudinal axis 180 is indicated by only one arrow in FIG. 6, the moveable side may also move in an opposite direction along the longitudinal axis 180.) In addition, the springs 264 (FIG. 5) may also allow slight rotation of the mating array 118 about any one or more of the axes 180, 182, and 184 if the mating array 118 and the communication component 104 are not oriented properly when the mating array 118 and the communication component 104 begin to engage. Also, the springs 264 may facilitate holding the mating array 118 parallel to the communication component 104 when in the retracted position.

Other moveable sides, coupling mechanisms, and connector assemblies including floatable mating arrays that are similar to the moveable sides, coupling mechanisms, and connector assemblies described herein are described in U.S. patent application Ser. No. 12/757,835, filed Apr. 9, 2010, which is hereby incorporated by reference in the entirety.

Furthermore, in embodiments where the terminals 132 include contact terminals having resilient beams, the springs 264 may work in conjunction with the resilient beams to electrically couple the mating array 118 to the communication component 104. The combined resilient forces of the terminals 132 and the floatable capability of the mating array 118 may cooperate in properly aligning the mating array 118 with the communication component 104.

However, alternative alignment mechanisms may be used. For example, the alignment feature 288 (FIG. 7) may be a cylindrical pin that projects from the mating array 118. The communication component 104 may have a conical or funnel-like aperture with a hole at the bottom configured to receive the pin. When the mating array 118 is moved toward the communication component 104, the pin may engage the surface of the conical aperture and be directed toward the hole where the pin is eventually received. This alternative alignment mechanism may operate similarly to the illustrated mechanism described above. In addition, the alignment feature 288 may have other shapes (e.g., pyramid, semi-spherical, and the like).

In other embodiments, the communication component 104 may have the alignment feature 288 and the mating array 118 may have the corresponding aperture 280 (FIG. 7). Furthermore, alternative embodiments may use multiple alignment features with the communication component 104 and the mating array 118. For example, the mating array 118 may have one alignment feature 288 configured to engage an aperture 280 in the communication component 104 and also one aperture configured to receive an alignment feature from the communication component 104.

Accordingly, if the terminals 132 are misaligned as the mating array 118 approaches the communication component 104, the floatable mating array 118 may be redirected in order to align and engage the associated terminals. The springs 264 allow the mating array 118 to move in various directions. Moreover, the springs 264 may be configured to provide an outward mating force in the mating direction $M_2$ to maintain the connection between the terminals 132 of the mating array 118 and the terminals of the communication component 104.

Figure 8:
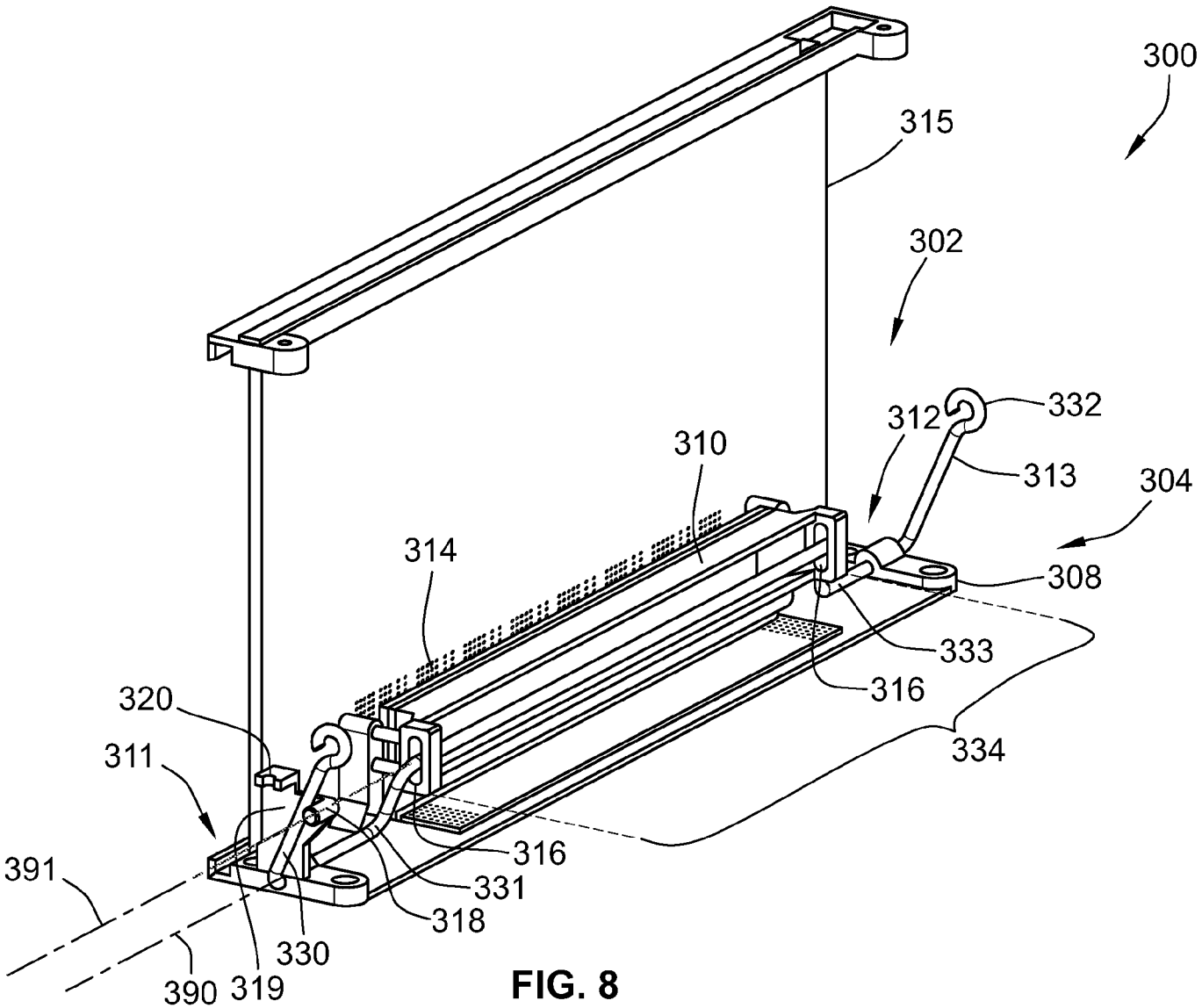
FIG. 8 is a perspective view of a connector assembly formed in accordance with an alternative embodiment.
Figure 9:
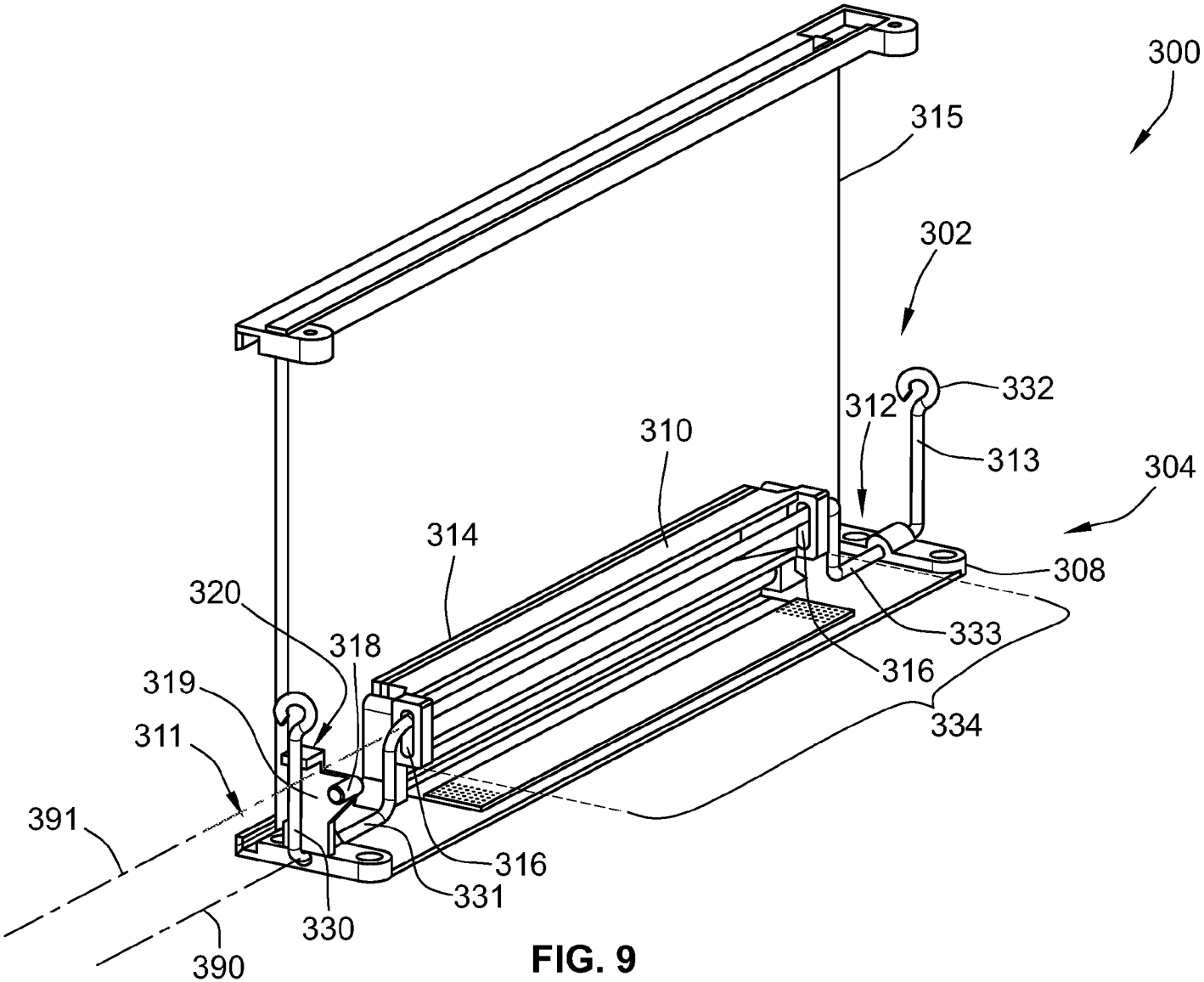
FIG. 9 is a perspective view of the connector assembly shown in FIG. 8 while in an engaged position.

FIGS. 8 and 9 are perspective views of a communication system 300 that includes a connector assembly 302 formed in accordance with an alternative embodiment. FIG. 8 shows the connector assembly 302 in a retracted position, and FIG. 9 shows the connector assembly 302 in an engaged position. The connector assembly 302 includes the coupling mechanism 304 and a interconnect assembly (not shown), which may have similar components and features as the interconnect assembly 16 (FIG. 1) and the interconnect assembly 114 (FIG. 5). The coupling mechanism 304 is configured to move a mating array 314 toward and away from a communication component 315 between the engaged and retracted positions. The communication component 315 is illustrated as a daughter card in FIGS. 8 and 9. The coupling mechanism 304 includes a base frame 308, a header 310 configured to hold the mating array 314, and an actuator assembly 312 configured to move the header 310 toward and away from the communication component 315. Also shown, the base frame 308 may include a board holder 311 for holding the communication component 315 proximate to the connector assembly 302. The board holder 311 is shown as a guide channel in FIGS. 8 and 9 that receives the communication component 315 and allows the communication component 315 to slide into position proximate to the connector assembly 302.

The actuator assembly 312 includes a lever structure 313 and cam slots 316 that are operatively coupled to the header 310. The actuator assembly 312 may also include an upright 319 that projects from the base frame 308 and forms a positive stop 318 and holder notch 320. As shown in FIGS. 8 and 9, the lever structure 313 cooperates with the cam slots 316 and header 310 in order to move the mating array 314 into the engaged and retracted positions. More specifically, the lever structure 313 has a cylindrical body that includes opposite arms 330 and 332 that project in a common vertical direction and a level portion 334 that extends between the arms 330 and 332 in a longitudinal direction. The level portion 334 connects to the arm 330 through a base portion 331 and connects to the arm 332 through a base portion 333. The base portions 331 and 333 extend along a base axis 390, whereas the level portion 334 extends along a separate but parallel level axis 391. The level portion 334 also extends between and through the cam slots 316. In alternative embodiments, the lever structure 313 may include only one arm 330 or arm 332.

In the retracted position shown in FIG. 8, the arm 330 may rest against the positive stop 318. When the lever structure 313 is moved such that the arms 330 and 332 and the level portion 334 rotate about the base axis 390, the level portion 334 pushes the header 310 toward the communication component 315. As the level portion 334 pushes the header 310, the cam slots 316 allow the body of the level portion 334 to slide upward therein. As shown in FIG. 9, when the header 310 is in the engaged position, the arm 330 of the lever structure 313 may rest within the holder notch 320. The holder notch 320 may provide a locking feature or mechanism that prevents the mating array 314 from being inadvertently disengaged with the communication component 315.

Figure 10:
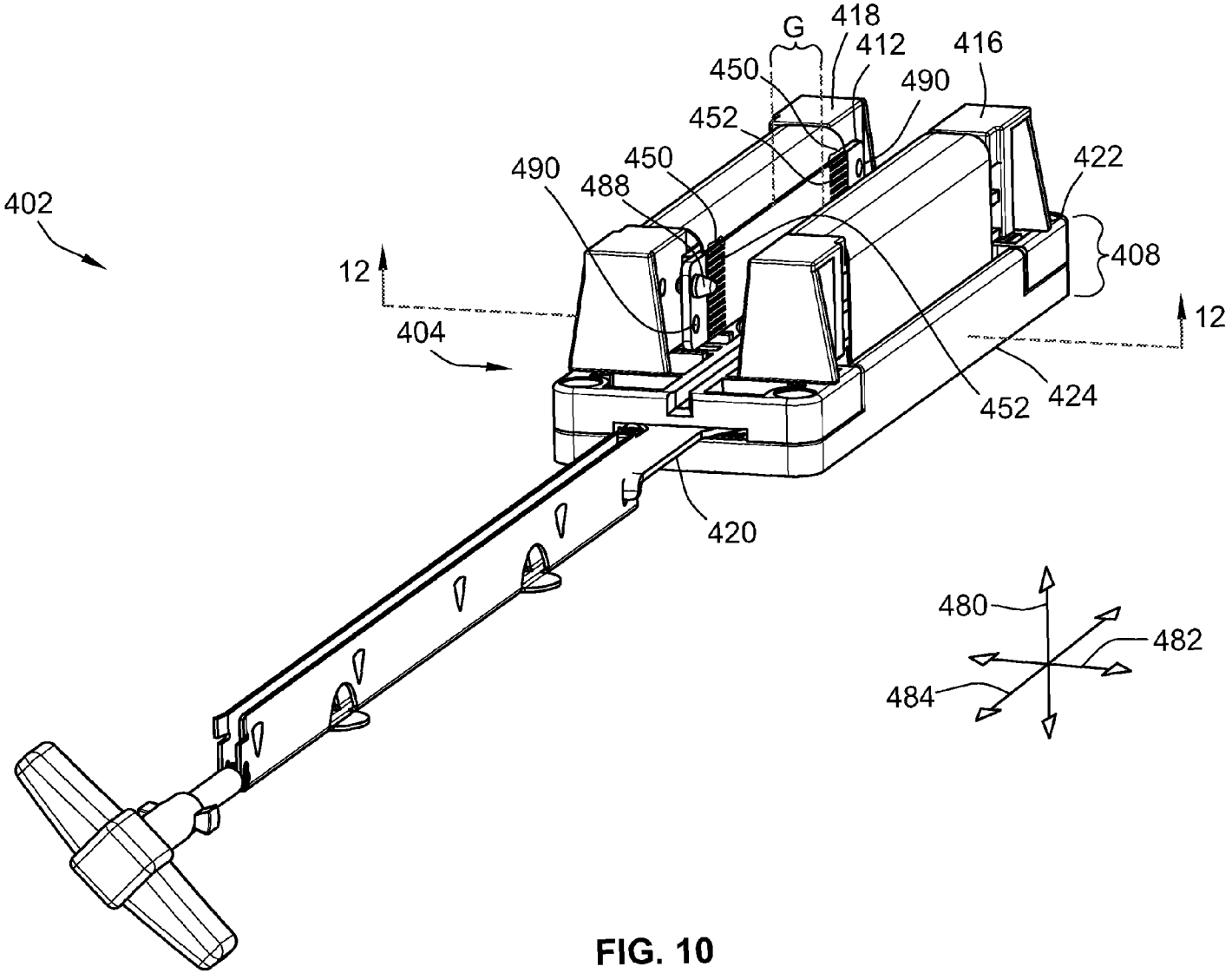
FIG. 10 is a perspective view of a connector assembly formed in accordance with another embodiment.

FIGS. 10-13 illustrate a connector assembly 402 that may be formed in accordance with another embodiment. FIG. 10 is a perspective view of the connector assembly 402. The connector assembly 402 includes a coupling mechanism 404 that is configured to move two moveable sides 410 (FIG. 11) and 412 toward a communication component (not shown) that is positioned between the moveable sides 410 and 412. Each of the moveable sides 410 and 412 includes matting arrays 450 having terminals 452. The communication component has complementary arrays of terminals (not shown) on both sides of the communication component that engage the corresponding mating arrays 450 on the moveable sides 410 and 412.

As shown in FIG. 10, the connector assembly 402 includes a base frame 408. The coupling mechanism 404 includes a pair of headers 416 and 418 that are slidably coupled to the base frame 408 and a sliding member 420 that is operatively coupled to the pair of headers 416 and 418 for moving the moveable sides 410 and 412 toward and away from the communication component. As will be discussed in greater detail below, the sliding member 420 is configured to move between an inserted position 492 (shown in FIG. 12) and a withdrawn position 489 (shown in FIG. 13). When the sliding member 420 is in the inserted position 492, the mating arrays 450 of the moveable sides 410 and 412 are in an engaged position and are communicatively coupled to the communication component. When the sliding member 420 is in the withdrawn position 489, the mating arrays 450 are in a retracted position (shown in FIG. 10) and the communication component may be removed from the connector assembly 402.

The moveable sides 410 and 412 oppose each other across a gap G where the communication component is held. Each of the moveable sides 410 and 412 or headers 416 and 418 may include an alignment projection 488 that projects from the corresponding surface and a bore 490 that is configured to receive the alignment projection 488 from the opposing mating array or header. With reference to the moveable side 412 in FIG. 10, each end of the moveable side 412 may include one alignment projection 488 and one bore 490. Although not shown, the opposing moveable side 410 may also include an alignment projection 488 and bore 490. When in the engaged position, the alignment projection 488 of the moveable side 410 extends through an aperture (not shown) of the communication component and into the corresponding bore 490 of the opposing moveable side 412. Likewise, the alignment projection 488 of the moveable side 412 extends through an aperture of the communication component and into the corresponding bore 490 of the opposing moveable side 410. As such, the communication component is sandwiched between the moveable sides 410 and 412. The alignment projections 488 and the bores 490 of the moveable sides 410 and 412 may cooperate with each other to facilitate aligning the associated terminals.

Figure 11:
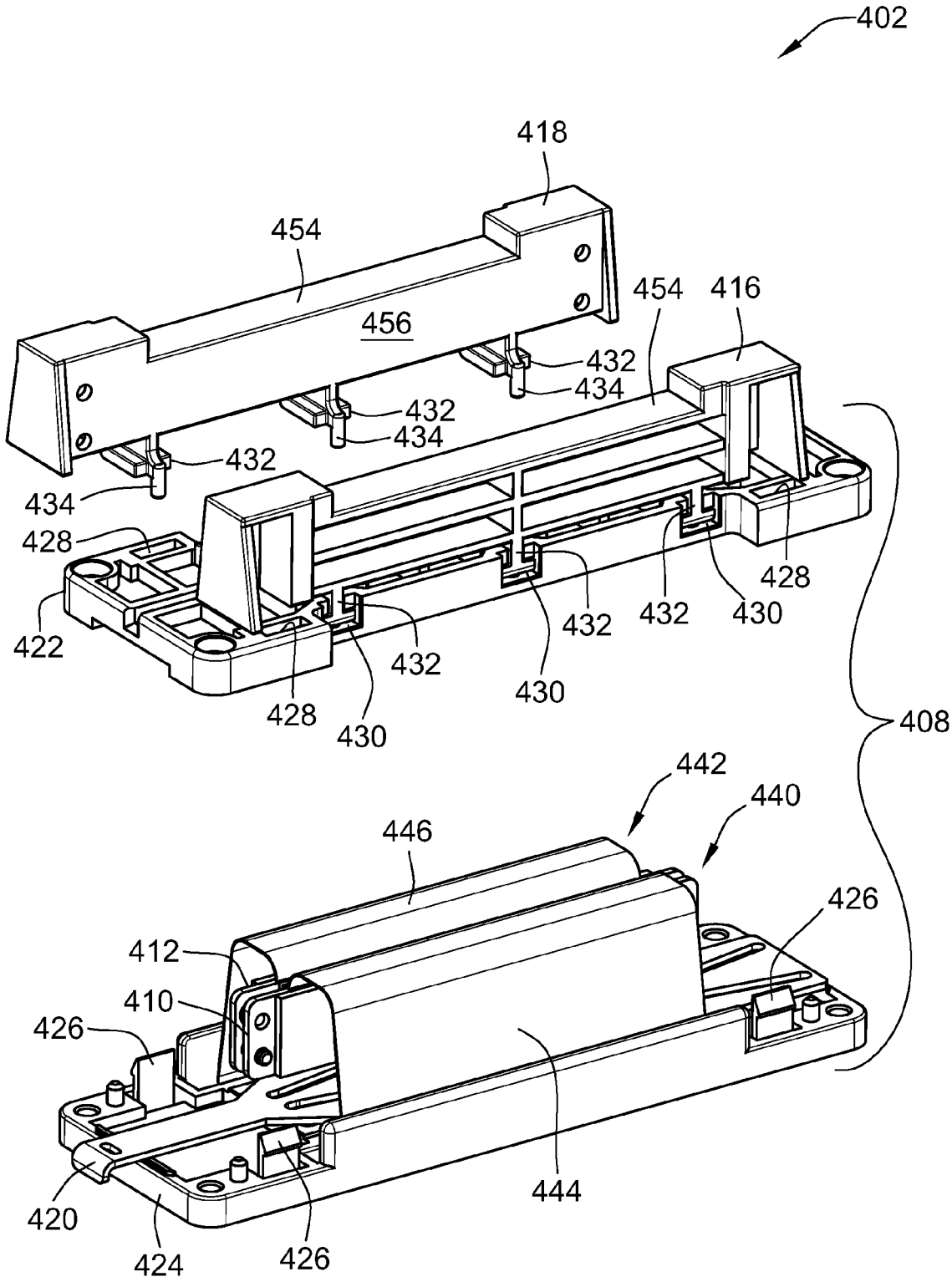
FIG. 11 is an exploded view of the connector assembly shown in FIG. 10.

As shown in FIG. 11, the base frame 408 may include a top portion 422 and a bottom portion 424. When the base frame 408 is constructed, the sliding member 420 is inserted between the top and bottom portions 422 and 424, respectively, and held therebetween. The bottom portion 424 may have tabs or latches 426 that project toward the top portion 422 and are configured to engage apertures 428 within the top portion 422 when the top and bottom portions 422 and 424 are combined. Also shown, the top portion 422 may include passages 430 distributed along each side of the top portion 422. Each passage 430 is configured to receive a leg support 432 of one of the headers 416 and 418. The leg supports 432 may slide within the corresponding passage 430 in a direction that is parallel to a mating axis 482 (FIG. 10) (i.e., orthogonal to a longitudinal axis 484 (FIG. 10)). Each leg support 432 includes a cam member 434 that projects downwardly in a direction parallel to a vertical axis 480 (FIG. 10).

The connector assembly 402 includes interconnect assemblies 440 and 442. The interconnect assembly 442 includes the mating array 450 of the moveable side 412 and a flex connection 446 that is coupled to the mating array 450. When the connector assembly 402 is fully assembled, the flex connection 446 may wrap around a top 454 of the header 418 and the mating array 450 may be floatably coupled to a face 456 of the header 418. The flex connection 446 has a length that is configured to allow the corresponding mating array 412 to be moved between the engaged and retracted positions. Similarly, the interconnect assembly 440 includes the mating array 450 of the moveable side 410 and a flex connection 444, which may be assembled as described above with respect to the interconnect assembly 442.

Figure 12:
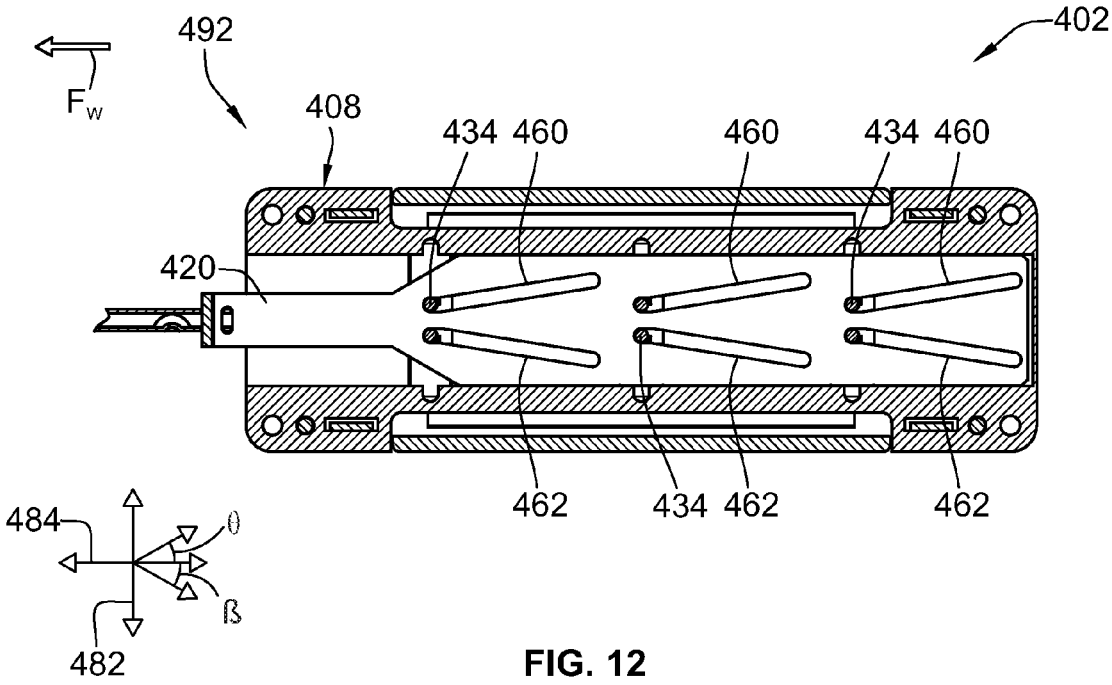
FIG. 12 is a bottom cross-sectional view of a coupling mechanism used with the connector assembly shown in FIG. 10 when in an engaged position.
Figure 13:
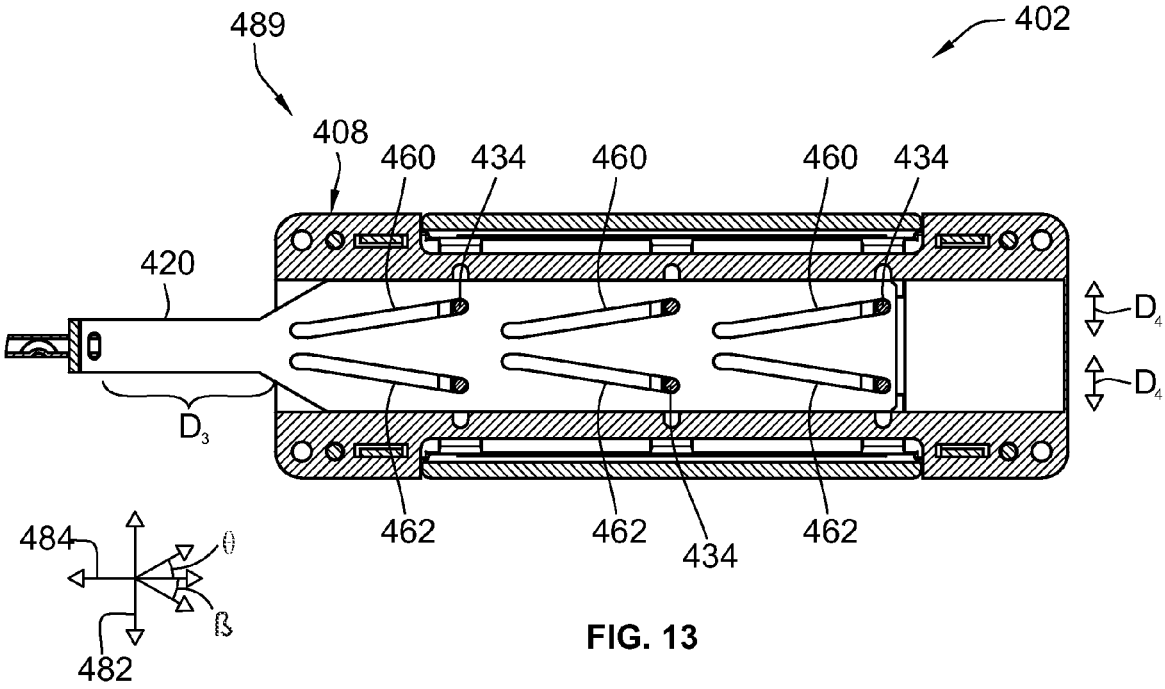
FIG. 13 is the bottom cross-sectional view of the coupling mechanism of FIG. 10 when in a retracted position.

FIGS. 12 and 13 are bottom cross-sectional views of the connector assembly 402 when the sliding member 420 is in the inserted and withdrawn positions 492 and 489, respectively. The sliding member 420 has a substantially flat body configured to slide in and out of the base frame 408 a distance $D_3$ (FIG. 13). The sliding member 420 substantially extends along a length of the base frame 408 and includes two series of cam slots 460 and 462 that extend lengthwise along the body of the sliding member 420. Each cam slot 460 forms an angle with respect to the longitudinal axis 484 (indicated as an angle $\theta$) and projects in a common direction with respect to the other cam slots 460. Likewise, each cam slot 462 forms an angle (indicated as an angle $\beta$) with respect to the longitudinal axis 484 and projects in a common direction with respect to the other cam slots 462. As shown, the angle $\beta$ has an equal value as $\theta$, but extends away from the longitudinal axis 484 in a different direction (i.e., downward instead of upward).

When a withdrawing force $F_W$ (FIG. 12) pulls the sliding member 420 in a direction along the longitudinal axis 484 and away from the base frame 408, the cam slots 460 and 462 are configured to move the cam members 434 away from the communication component causing the corresponding headers 416 (FIG. 10) and 418 (FIG. 10) to be moved away from the communication component (i.e., along the mating axis 482). As such, the withdrawing force $F_W$ is translated into a separating force or movement that simultaneously moves the headers 416 and 418 and corresponding moveable sides 410 and 412 (FIG. 11) away from the communication component. Furthermore, because the series of cam slots 460 and 462 are symmetrical, the corresponding headers 416 and 418 move an equal distance $D_4$ (FIG. 13) away from the communication component.

However, alternative embodiments are not required to have symmetrical series of cam slots 460 and 462 and the angles θ and β are not required to be equal. Furthermore, the headers 416 and 418 are not required to move an equal distance. For example, in an alternative embodiment, the angle θ may be greater than the angle β. When the sliding member 420 is withdrawn, the header 416 moves at a greater speed and/or to a greater distance than the header 418. Various other configurations of cam slots 460 and 462 can be used to control movement of the headers 416 and 418 as desired.

Figure 14:
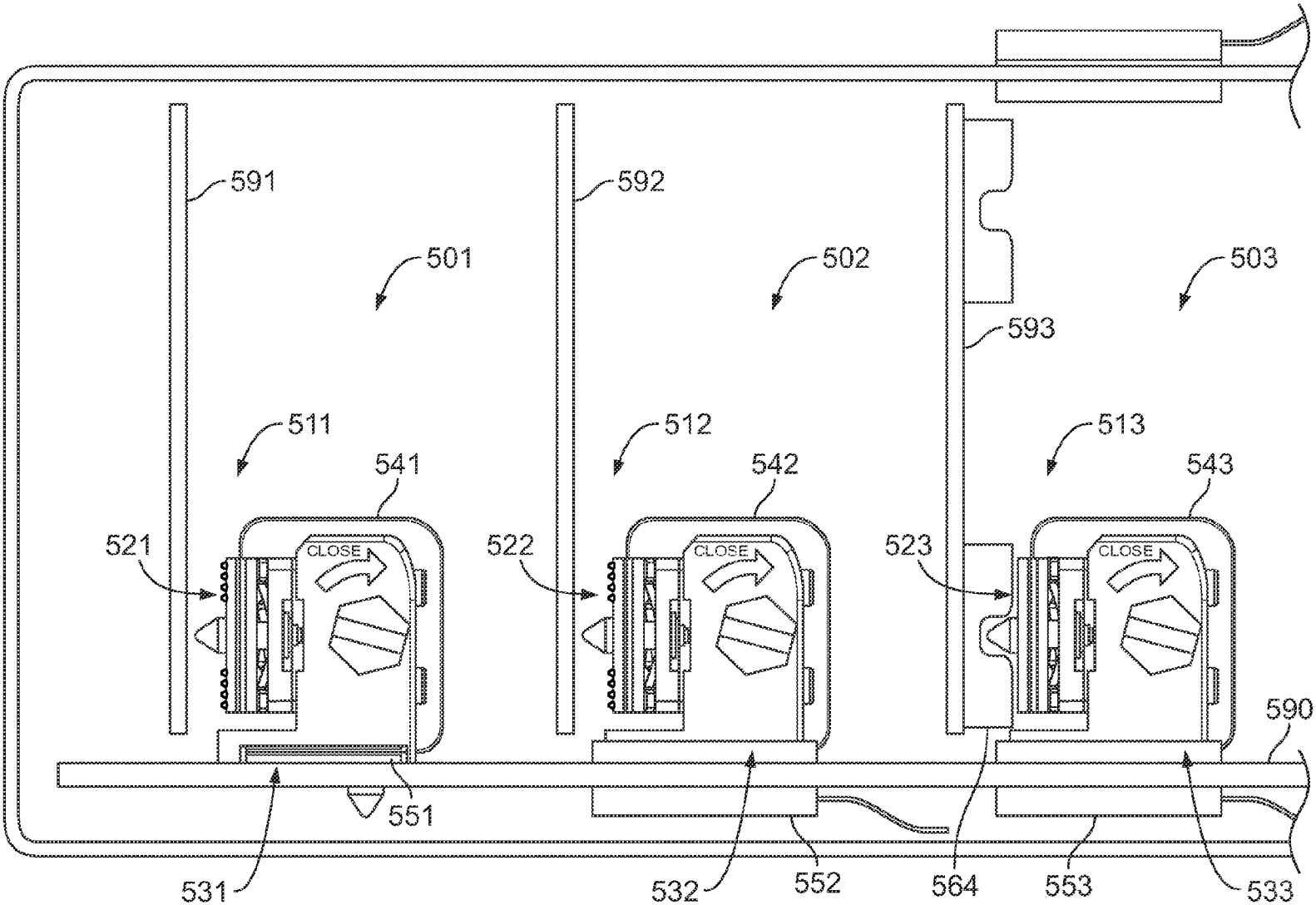
FIG. 14 illustrates other connector assemblies formed in accordance with various embodiments.
Figure 15:
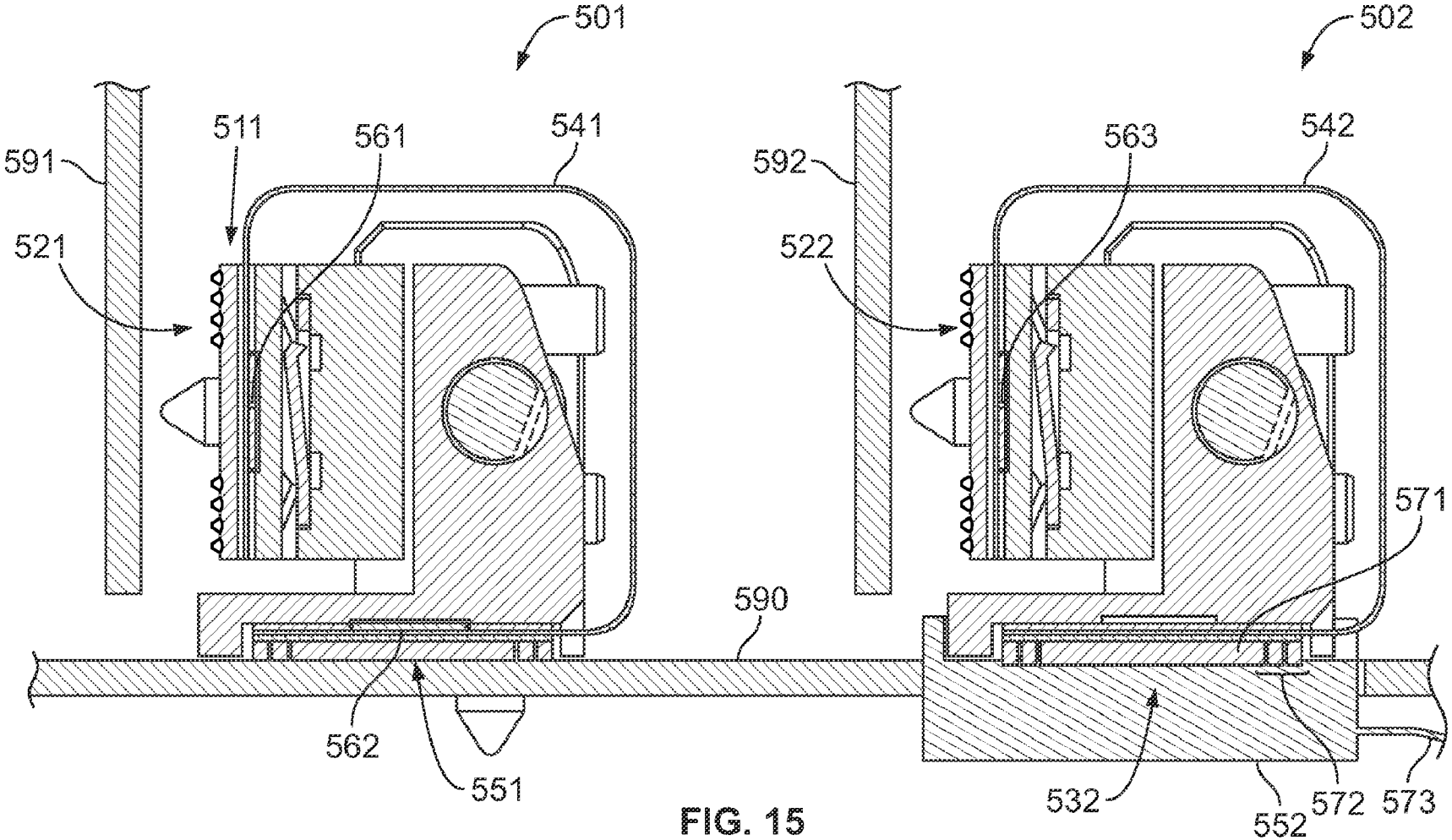
FIG. 15 illustrates cross-sections of two of the connector assemblies shown in FIG. 14.
Figure 16:
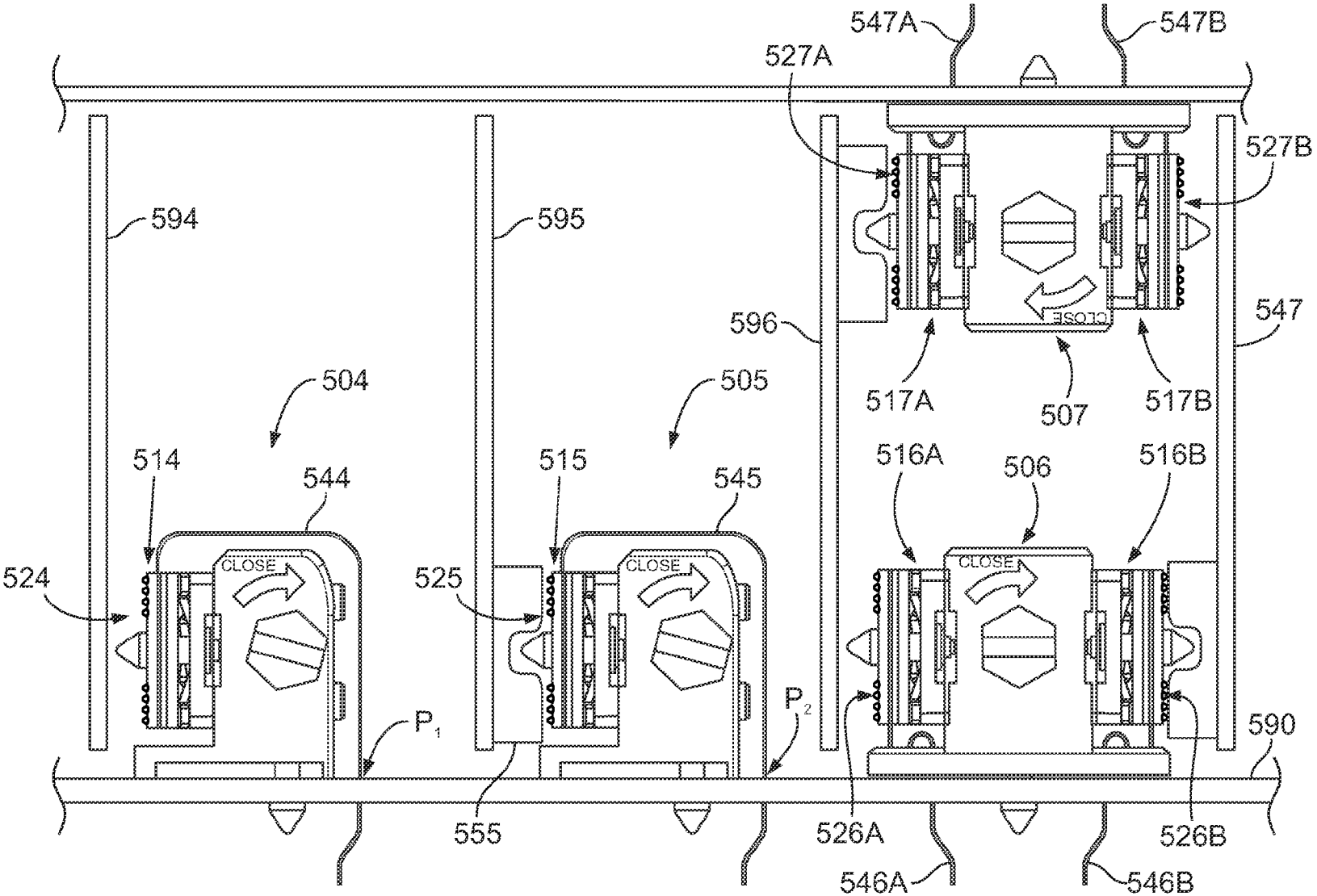
FIG. 16 illustrates other connector assemblies formed in accordance with various embodiments.

FIGS. 14-16 illustrate various embodiments of connector assemblies that include moveable sides having mating arrays that are configured to establish electrical and/or optical connections. FIG. 14 shows connector assemblies 501-503. The connector assemblies 501-503 are mounted to a common motherboard 590, which may be another type of communication component in alternative embodiments. The connector assemblies 501-503 include moveable sides 511-513, respectively, that have mating arrays 521-523, respectively. The connector assemblies 501-503 include mounting sides 531-533, respectively. As shown in FIG. 14, the connector assemblies 501-503 are in retracted positions and are configured to communicatively couple to corresponding daughter cards 591-593, respectively. However, in alternative embodiments, the daughter cards 591-593 may be other communication components. To this end, the connector assemblies 501-503 may include flex connections 541-543 that include at least one of optical fibers and conductive pathways. The flex connections 541-543 may communicatively couple the mating arrays 521-523 to the motherboard 590.

Each of the connector assemblies 501-503 may form signal pathways that interconnect the daughter cards 591-593, respectively, to the motherboard 590. For example, the connector assembly 501 may have a signal pathway that extends from the mating array 521, through the flex connection 541, and to a mating array 551 that is mounted to the motherboard 590. The connector assembly 502 may have a signal pathway that extends from the mating array 522, through the flex connection 542, and to an optical connector 552 that is mounted to the motherboard 590. Furthermore, the connector assembly 503 may have a signal pathway that extends from the mating array 523, through the flex connection 543, and to an optical connector 553 that is mounted to the motherboard 590.

In some embodiments, at least a portion of the signal pathway of each connector assembly 501-503 may permit optical transmissions. More specifically, at least one of the mating array(s) and the flex connection(s) may be configured to transmit optical signals. For example, the flex connections 541-543 may comprise fiber optic cables (or ribbons) that include a plurality of optical fibers. The mating arrays 521-523 may include optical terminals including fiber ends that permit optical transmission.

FIG. 15 illustrates a cross-section of the connector assembly 501 and the connector assembly 502. As shown, the connector assembly 501 may include a signal converter 561 that is communicatively coupled to the mating array 521 and a signal converter 562 that is communicatively coupled to the mating array 551. The signal converter 561 may be a part of the moveable side 511. For example, the signal converter 561 may be have a fixed position with respect to the mating array 521 and move with the mating array 521 and the moveable side 511 when the moveable side 511 is selectively moved by a coupling mechanism, such as the coupling mechanisms described above. The signal converter 561 may be directly attached to the mating array 521.

The signal converters 561 and 562 are configured to receive data signals of a first signal form and convert the data signal into a different second signal form. For example, the signal converter 561 may receive electrical signals from the mating array 521 and convert the electrical signals into optical signals that are transmitted along the flex connection 541. As such, the signal converter 561 may include a modulator that receives the electrical signals from the mating array 521. (The electrical signals may be provided to the mating array 521 from the daughter card 591.) The modulator may encode the data signals for optical transmission. The signal converter 561 may also include a light source (e.g., LED) that is driven by the modulator to produce the optical signals.

In such embodiments, the signal converter 562 receives the optical signals from the signal converter 561 through the flex connection 541. The signal converter 562 may include a detector that detects the optical signals and converts the optical signals into electrical form (i.e., converts the optical signals into electrical signals). The electrical signals may be amplified and decoded to replicate the electrical signals that were originally provided by the mating array 521 to the signal converter 561.

In other embodiments, the signal converter 562 may receive electrical signals from the mating array 551 and convert the electrical signals into optical signals that are transmitted along the flex connection 541. The signal converter 562 may also include a modulator that receives the electrical signals from a complementary array (not shown) of the motherboard 590 and a light source that is driven by the modulator to produce the optical signals. In such embodiments, the signal converter 561 may receive and decode the optical signals. In other embodiments, each of the signal converters 561 and 562 may convert electrical signals into optical signals and also convert optical signals into electrical signals.

Also shown in FIG. 15, the connector assembly 502 may include a signal converter 563 that is communicatively coupled to the mating array 522. The optical connector 552 may be mounted to the motherboard 590 and mounted to the mounting side 532 of the connector assembly 502. The flex connection 542 of the connector assembly 502 may communicatively couple to the optical connector 552 through a connector interface 571. For example, the connector interface 571 may include a plurality of optical fiber interconnects 572 that join a fiber optic cable 573 to the optical fibers of the flex connection 542. Similar to above, the signal converter 563 may receive electrical signals from the mating array 522 and convert the electrical signals into optical signals that are transmitted along the flex connection 542 to the optical connector 552 where the optical signals are transmitted therefrom through the fiber optic cable 573 to a remote communication component (not shown). Likewise, optical signals may also be transmitted from the optical connector 552, through the flex connection 542, to the signal converter 563.

Although not shown, the signal pathways may include other optical devices or elements that facilitate optical transmission in addition to the signal converters and flex connections already described. For example, the signal pathways may include amplifiers, receivers, transmitters, splitters, couplers, filters, switches, and the like to facilitate optical communication. Such components may be part of the connector assembly if suitable (e.g., attached to a base frame, a moveable side, or a mating array), or such components may be remotely located with respect to the connector assembly. Furthermore, the signal converter 561 is not required to be within or attached to the moveable side 511. For example, the signal converter 561 can be mounted to the motherboard 590 or located within the flex connection 541.

Returning to FIG. 14, the mating array 523 includes a plurality of optical terminals and is configured to communicatively engage an optical connector 564 of the daughter card 593. The optical connector 564 may be configured to receive and direct the mating array 523 so that the optical terminals of the mating array 523 are properly aligned with optical terminals of a complementary array (not shown) in the optical connector 564. The optical connector 564 may include a signal converter similar to those described above.

FIG. 16 shows connector assemblies 504-507. The connector assemblies 504-507 may be mounted to the common motherboard 590 or another type of communication component. The connector assemblies 504-507 include moveable sides 514-517, respectively, that have mating arrays 524-527, respectively. The connector assembly 506 has two opposite moveable sides 516A and 516B that include respective mating arrays 526A and 526B. The connector assembly 507 has two opposite moveable sides 517A and 517B that include respective mating arrays 527A and 527B.

As shown in FIG. 16, the connector assemblies 504-507 are in retracted positions with respect to daughter cards 594-597. The connector assemblies 504-507 are configured to communicatively couple to daughter cards 594-597. Each of the connector assemblies 506 and 507 is configured to communicatively couple to both of the daughter cards 596 and 597. In alternative embodiments, the daughter cards 594-597 may be other communication components. The connector assemblies 504 and 505 may include flex connections 544 and 545, and the connector assemblies 506 and 507 may include flex connections 546A, 546B and 547A, 547B, respectively. The flex connections 544, 545, 546A, 546B, 547A, and 547B may include at least one of optical fibers and conductive pathways.

At least a portion of the signal pathway of each connector assembly 504-507 may permit optical transmissions. With respect to the connector assemblies 504 and 505 shown in FIG. 16, the flex connections 544 and 545 may pass through the motherboard 590. For example, the flex connections 544 and 545 may extend from remote locations, such as a remote connector or other communication component (not shown), to respective pass-through point P1 and P2 on the motherboard 590. The flex connections 544 and 545 extend from the respective pass-through points P1 and P2 to the respective mating arrays 524 and 525. In some embodiments, the motherboard 590 has holes or slots at the pass-through points P1 and P2 that allow the flex connections 544 and 545 to be freely inserted and moveable therethrough.

In other embodiments, the flex connections 544 and 545 may be inserted through the holes or slots and attached thereto (e.g., using an adhesive or clip). In such cases, the pass-through points P1 and P2 may represent base ends of the flex connections 544 and 545 (described above) that facilitate limiting a bend radius of the flex connections 544 and 545. Also, in alternative embodiments, the flex connections 544 and 545 do not extend through a pass-through point located proximate to the respective connector assembly 504 and 505. Instead, the flex connections 544 and 545 may extend from a remote location and directly attach to the respective connector assembly 504 and 505 or, more specifically, to the respective mating array 524 and 525.

The connector assembly 504 may include a signal converter (not shown) located proximate to the mating array 524 that converts the data signals from a first form to a different second form (e.g., from optical to electrical or from electrical to optical). However, the mating array 525 of the connector assembly 505 may be configured to communicatively engage an optical connector 555 that is mounted to the daughter card 595. In such embodiments, the optical connector 555 and the mating array 525 may be configured to align optical terminals (not shown) to establish an optical connection. The optical connector 555 may, in turn, include a signal converter (not shown) that is communicatively coupled to the daughter card 595.

The connector assembly 506 may be configured to selectively move the mating arrays 526A and 526B in opposite directions simultaneously or according to a predetermined sequence. Likewise, the connector assembly 507 may be configured to selectively move the mating arrays 527A and 527B in opposite directions simultaneously or according to a predetermined sequence. Such embodiments are described in greater detail in U.S. patent application Ser. Nos. 12/686,484 and 12/686,518, which are incorporated by reference in their entirety. Furthermore, as described with respect to other connector assemblies, the conversion of the data signals from one form to another may occur within the corresponding connector assembly or within an optical connector that is configured to communicatively engage the mating array of the connector assembly.

It is to be understood that the above description is intended to be illustrative, and not restrictive. As such, other connectors and coupling mechanisms may be made as described herein that removably couple a moveable mating array to a complementary array. For example, the connector assemblies and coupling mechanisms may be similar to the connector assemblies and coupling mechanisms described in U.S. patent application Ser. Nos. 12/428,851; 12/428,806; 12/686,484; 12/686,518; 12/757,835; 12/646,314; and 12/685,398; all of which are incorporated by reference in their entirety. By way of one example, the coupling mechanism may include an operator-controlled actuator that is slidable along a longitudinal axis. The actuator may have ramps that engage roll bars or bearings within the connector assembly. When the ramps push the bearings outward, a moveable side is also pushed in a mating direction toward a communication component. Such a coupling mechanism is described in greater detail in U.S. patent application Ser. No. 12/685,398, which is incorporated by reference in the entirety. Furthermore, connector assemblies described herein may also be configured to move a plurality of mating arrays in different directions and/or at different times according to a predetermined sequence. Such connector assemblies are described in greater detail in U.S. patent application Ser. Nos. 12/686,484 and 12/686,518, which are incorporated by reference in their entirety. Connector assemblies described herein may also be used with removable card connector assemblies, such as those described in U.S. patent application Ser. Nos. 12/428,851 and 12/686,518, which are both incorporated by reference in their entirety.

In addition, the above-described embodiments (and/or aspects thereof) may be used in combination with each other.

Furthermore, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a base frame extending along a longitudinal axis between a pair of frame ends;

a moveable side supported by the base frame and extending in a direction along the longitudinal axis, the moveable side comprising a mating array of terminals;

a flex connection communicatively coupled to the mating array, the flex connection and the mating array being configured to transmit data signals; and a coupling mechanism supported by the base frame and being operatively coupled to the moveable side, the coupling mechanism configured to be actuated to move the moveable side between retracted and engaged positions along a mating direction, the mating array being spaced apart from a complementary array of terminals when held by the coupling mechanism in the retracted position and communicatively coupled to the complementary array when held by the coupling mechanism in the engaged position.

2. The connector assembly in accordance with claim 1, wherein the mating array of terminals comprises at least one of optical terminals for transmitting optical signals and contact terminals for transmitting electrical current.

3. The connector assembly in accordance with claim 1, wherein at least one of the flex connection and the mating array is configured to transmit optical signals.

4. The connector assembly in accordance with claim 1, wherein the flex connection includes a plurality of optical fibers.

5. The connector assembly in accordance with claim 4, wherein the flex connection has an operative length that extends between distal and base ends, the distal end being attached to the moveable side, wherein the operative length of the flex connection is configured to limit a bend radius of the optical fibers.

6. The connector assembly in accordance with claim 1, wherein the mating array of terminals includes optical terminals for transmitting optical signals.

7. The connector assembly in accordance with claim 1, further comprising a signal converter that at least one of (a) converts electrical signals into optical signals and (b) converts optical signals into electrical signals.

8. The connector assembly in accordance with claim 1 further comprising an alignment feature having a fixed position with respect to the mating array, said alignment feature cooperating with another alignment feature of a communication component having the complementary array to align the mating array with the complementary array when moved into the engaged position.

9. The connector assembly in accordance with claim 1, wherein the mating array is floatable in at least one direction that is perpendicular to the mating direction.

10. The connector assembly in accordance with claim 1, wherein the mating direction is substantially orthogonal to the longitudinal axis, the mating array being moved in a linear manner between the engaged and retracted positions.

11. The connector assembly in accordance with claim 1, wherein the coupling mechanism comprises an operator-controlled actuator that is movably supported by the base frame, the coupling mechanism including at least one intermediate component that operatively couples the actuator to the moveable side.

12. The connector assembly in accordance with claim 11, wherein the actuator is rotatable about a central axis, the actuator driving the moveable side along the mating direction when rotated about the central axis.

13. The connector assembly in accordance with claim 11, wherein the actuator is slidable in the direction along the longitudinal axis, the actuator driving the moveable side along the mating direction when moved in the direction along the longitudinal axis.

14. A connector assembly comprising:

a base frame;

a moveable side supported by the base frame, the moveable side being moveable relative to the base frame and comprising a mating array of terminals;

a flex connection attached to the moveable side and communicatively coupled to the mating array, the flex connection and the mating array configured to transmit data signals; and a coupling mechanism comprising an operator-controlled actuator, the actuator being operatively coupled to the moveable side;

wherein the actuator is configured to drive the moveable side between retracted and engaged positions along a mating direction when moved by an operator, the mating array being spaced apart from a complementary array of terminals in the retracted position and communicatively coupled to the complementary array in the engaged position, the coupling mechanism configured to move the mating array away from the complementary array.

15. The connector assembly in accordance with claim 14, wherein at least one of the flex connection and the mating array is configured to transmit optical signals.

16. The connector assembly in accordance with claim 14, wherein the flex connection includes a plurality of optical fibers.

17. The connector assembly in accordance with claim 14, further comprising a signal converter that at least one of (a) converts electrical signals into optical signals and (b) converts optical signals into electrical signals.

18. The connector assembly in accordance with claim 14, wherein the actuator extends in a direction along a longitudinal axis, the mating direction being substantially orthogonal to the longitudinal axis, the mating array being moved in a linear manner between the engaged and retracted positions.

19. The connector assembly in accordance with claim 14, wherein the actuator is rotatable about a central axis, the actuator driving the moveable side along the mating direction when rotated about the central axis.

20. The connector assembly in accordance with claim 14, wherein the actuator is slidable in a direction along a longitudinal axis, the actuator driving the moveable side along the mating direction when moved in the direction along the longitudinal axis, the mating direction being different than the direction along the longitudinal axis.

* * * * *